US008665164B2

(12) United States Patent
Hill et al.

(10) Patent No.: US 8,665,164 B2
(45) Date of Patent: Mar. 4, 2014

(54) MULTIBAND HANDHELD ELECTRONIC DEVICE SLOT ANTENNA

(75) Inventors: Robert J. Hill, Salinas, CA (US); Robert W. Schlub, Campbell, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 826 days.

(21) Appl. No.: 12/274,311

(22) Filed: Nov. 19, 2008

(65) Prior Publication Data

US 2010/0123632 A1 May 20, 2010

(51) Int. Cl.
*H01Q 13/10* (2006.01)
*H01Q 1/24* (2006.01)

(52) U.S. Cl.
USPC ..... 343/767; 343/769; 343/702

(58) Field of Classification Search
USPC ..... 343/782, 767, 702, 795
See application file for complete search history.

(56) References Cited

U.S. PATENT DOCUMENTS

| | | | | |
|---|---|---|---|---|
| 6,670,923 | B1 | 12/2003 | Kadambi et al. | |
| 6,741,214 | B1 | 5/2004 | Kadambi et al. | |
| 6,747,601 | B2 | 6/2004 | Boyle | |
| 6,762,723 | B2 * | 7/2004 | Nallo et al. | 343/700 MS |
| 6,856,294 | B2 | 2/2005 | Kadambi et al. | |
| 6,879,293 | B2 * | 4/2005 | Sato | 343/702 |
| 6,980,154 | B2 | 12/2005 | Vance et al. | |
| 7,027,838 | B2 | 4/2006 | Zhou et al. | |
| 7,116,276 | B2 | 10/2006 | Lee | |
| 7,119,747 | B2 | 10/2006 | Lin et al. | |
| 7,123,208 | B2 | 10/2006 | Baliarda et al. | |
| 7,317,901 | B2 * | 1/2008 | Navsariwala et al. | 455/82 |
| 7,595,759 | B2 | 9/2009 | Schlub et al. | |
| 7,612,725 | B2 | 11/2009 | Hill et al. | |
| 7,808,438 | B2 | 10/2010 | Schlub et al. | |
| 7,843,396 | B2 | 11/2010 | Hill et al. | |
| 7,864,123 | B2 | 1/2011 | Hill et al. | |
| 7,876,274 | B2 | 1/2011 | Hobson et al. | |
| 7,889,139 | B2 | 2/2011 | Hobson et al. | |
| 7,893,883 | B2 | 2/2011 | Schlub et al. | |

(Continued)

FOREIGN PATENT DOCUMENTS

| | | |
|---|---|---|
| EP | 1 401 050 | 3/2004 |
| WO | 2005/109567 | 11/2005 |
| WO | WO 2007058230 A1 * | 5/2007 |

OTHER PUBLICATIONS

U.S. Appl. No. 11/821,192, filed Jun. 21, 2007, Hill et al.

(Continued)

*Primary Examiner* — Jacob Y Choi
*Assistant Examiner* — Amal Patel
(74) *Attorney, Agent, or Firm* — Treyz Law Group; G. Victor Treyz; David C. Kellogg

(57) ABSTRACT

An electronic device such as a portable electronic device may have an antenna and associated wireless communications circuitry. The antenna may be a slot antenna having a dielectric slot opening. The slot opening may have a shape such as a U shape or an L shape in which elongated regions of the slot run parallel to the edges of the portable electronic device. The portable electronic device may have a housing with conductive sidewalls. The conductive sidewalls may help define the shape of the slot. Antenna feed arrangements may be used to feed the slot antenna in a way that excites harmonic frequencies and that supports multiband operation while being shielded from proximity effects.

20 Claims, 22 Drawing Sheets

(56) References Cited

U.S. PATENT DOCUMENTS

| | | | | |
|---|---|---|---|---|
| 7,898,485 | B2 | 3/2011 | Schlub et al. | |
| 7,911,387 | B2 | 3/2011 | Hill et al. | |
| 7,924,231 | B2 | 4/2011 | Hill et al. | |
| 2003/0107518 | A1 | 6/2003 | Li et al. | |
| 2004/0145521 | A1 | 7/2004 | Hebron et al. | |
| 2004/0257283 | A1* | 12/2004 | Asano et al. | 343/702 |
| 2006/0038733 | A1* | 2/2006 | Wedel et al. | 343/795 |
| 2006/0055606 | A1 | 3/2006 | Boyle | |
| 2006/0097941 | A1 | 5/2006 | Bettner et al. | |
| 2006/0125703 | A1 | 6/2006 | Ma et al. | |
| 2007/0120749 | A1* | 5/2007 | Tsai et al. | 343/702 |
| 2008/0165065 | A1 | 7/2008 | Hill et al. | |
| 2009/0040115 | A1 | 2/2009 | Zhang et al. | |
| 2009/0153410 | A1* | 6/2009 | Chiang et al. | 343/702 |
| 2009/0231215 | A1* | 9/2009 | Taura | 343/702 |
| 2009/0256759 | A1 | 10/2009 | Hill et al. | |
| 2009/0303139 | A1 | 12/2009 | Schlub et al. | |
| 2011/0109516 | A1 | 5/2011 | Hobson et al. | |

OTHER PUBLICATIONS

U.S. Appl. No. 11/895,053, filed Aug. 22, 2007, Zhang et al.
U.S. Appl. No. 11/956,314, filed Dec. 13, 2007, Zhang et al.
Schlub et al., U.S. Appl. No. 13/092,875, filed Apr. 22, 2011.
Hobson et al., U.S. Appl. No. 13/021,689, filed Feb. 4, 2011.
Hill et al., U.S. Appl. No. 13/083,487, filed Apr. 8, 2011.
Jarvis et al., U.S. Appl. No. 12/823,929, filed Jun. 25, 2010.
Nickel et al., U.S. Appl. No. 12/752,966, filed Apr. 1, 2010.
Pascolini et al., U.S. Appl. No. 12/630,756, filed Dec. 3, 2009.
Pascolini et al., U.S. Appl. No. 12/789,400, filed May 27, 2010.
Caballero et al., U.S. Appl. No. 12/941,010, filed Nov. 5, 2010.

* cited by examiner

MULTIBAND HANDHELD ELECTRONIC DEVICE SLOT ANTENNA

BACKGROUND

This invention relates generally to electronic devices, and more particularly, to antennas for electronic device such portable electronic devices.

Electronic devices such as handheld electronic devices and other portable electronic devices are becoming increasingly popular. Examples of handheld devices include handheld computers, cellular telephones, media players, and hybrid devices that include the functionality of multiple devices of this type. Popular portable electronic devices that are somewhat larger than traditional handheld electronic devices include laptop computers and tablet computers.

Due in part to their mobile nature, portable electronic devices are often provided with wireless communications capabilities. For example, handheld electronic devices may use long-range wireless communications to communicate with wireless base stations. Cellular telephones and other devices with cellular capabilities may communicate using cellular telephone bands at 850 MHz, 900 MHz, 1800 MHz, 1900 MHz, and 2100 MHz. Portable electronic devices may also use short-range wireless communications links. For example, portable electronic devices may communicate using the Wi-Fi® (IEEE 802.11) bands at 2.4 GHz and 5.0 GHz and the Bluetooth® band at 2.4 GHz. Global positioning system signals at 1575 MHz may also be received by cellular telephones.

Although it is desirable to provide handheld devices with a broad range of wireless capabilities, it can be difficult to do so in the relatively small amount of space available in many portable devices. Portable devices may have conductive housings and conductive components that can impede satisfactory antenna operation. Often an antenna can be formed in a portable device only by making a design compromise that involves relocating other components. If there is insufficient space available to relocate a conductive structure, it may be necessary to enlarge the electronic device or make other device modifications, some of which may not be aesthetically or functionally desirable.

It would therefore be advantageous to be able to provide electronic devices with improved antennas.

SUMMARY

An electronic device such as a handheld electronic device or other portable electronic device may be provided that has wireless communications capabilities. An antenna may be used to transmit and receive radio-frequency signals. The signals may be associated with cellular telephone communications bands. With one suitable arrangement, a slot antenna may be provided that handles multiple cellular telephone bands. The slot antenna may be, for example, a pentaband slot antenna.

Conductive structures in the electronic device and conductive housing portions may be used in defining the shape of the slot antenna. The housing portions may include conductive housing sidewalls. The conductive structures in the device may include structural members and electronic device components such as buttons, flex circuit data paths, connectors, speakers, and printed circuit boards. The housing sidewalls and conductive structures may be configured to form a slot with an elongated slot shape for the slot antenna. The elongated slot shape may be substantially rectangular and may include one or more bends. The bends may be used to ensure that the entire length of the slot fits within the confines of the housing of the electronic device.

The slot may have a shape such as a U shape or an L shape in which elongated regions of the slot run parallel to the edges of the portable electronic device. A U-shaped antenna may have first and second arms of equal length (i.e., a symmetric configuration) or first and second arms of unequal length (i.e., an asymmetric configuration). An L-shaped slot may have a first elongated portion with a longitudinal axis that runs parallel to one of the housing sidewalls in the device (e.g., the right-hand sidewall). This type of L-shaped slot may also have a second elongated portion having a longitudinal axis that runs perpendicular to the first longitudinal axis. The slot may be routed around conductive components in the device such as a data connector and its associated flex circuit data path. Conductive components such as a speaker may be formed within the slot so as to be completely surrounded by the slot. This type of arrangement may form branch paths within the slot, so that the slot has multiple associated lengths.

Further features of the invention, its nature and various advantages will be more apparent from the accompanying drawings and the following detailed description of the preferred embodiments.

DETAILED DESCRIPTION

The present invention relates generally to electronic devices, and more particularly, to antennas in portable electronic devices such as handheld electronic devices. The antennas may be slot antennas that cover one or more communications bands of interest. If desired, other (non-slot) antenna types may be used in conjunction with a slot antenna either to form a hybrid antenna or to form one or more optional separate antennas for an electronic device.

The use of antenna structures that can handle radio-frequency signals in more than one band helps to reduce the number of separate antennas required in an electronic device. The use of multiband slot antennas is therefore sometimes described herein as an example. If desired, slot antennas may be formed that cover single bands of interest.

The electronic devices that contain the multiband slot antennas may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, the portable electronic devices may be handheld electronic devices.

The electronic devices may be, for example, handheld wireless devices such as cellular telephones, media players with wireless communications capabilities, handheld computers (also sometimes called personal digital assistants), remote controllers, global positioning system (GPS) devices, and handheld gaming devices. The electronic devices may also be hybrid devices that combine the functionality of multiple conventional devices. Examples of hybrid portable electronic devices include a cellular telephone that includes media player functionality, a gaming device that includes a wireless communications capability, a cellular telephone that includes game and email functions, and a portable device that receives email, supports mobile telephone calls, has music player functionality and supports web browsing. The electronic device may be a cellular telephone such as the iPhone® cellular telephone available from Apple Inc. of Cupertino, Calif. These are merely illustrative examples.

Figure 1:
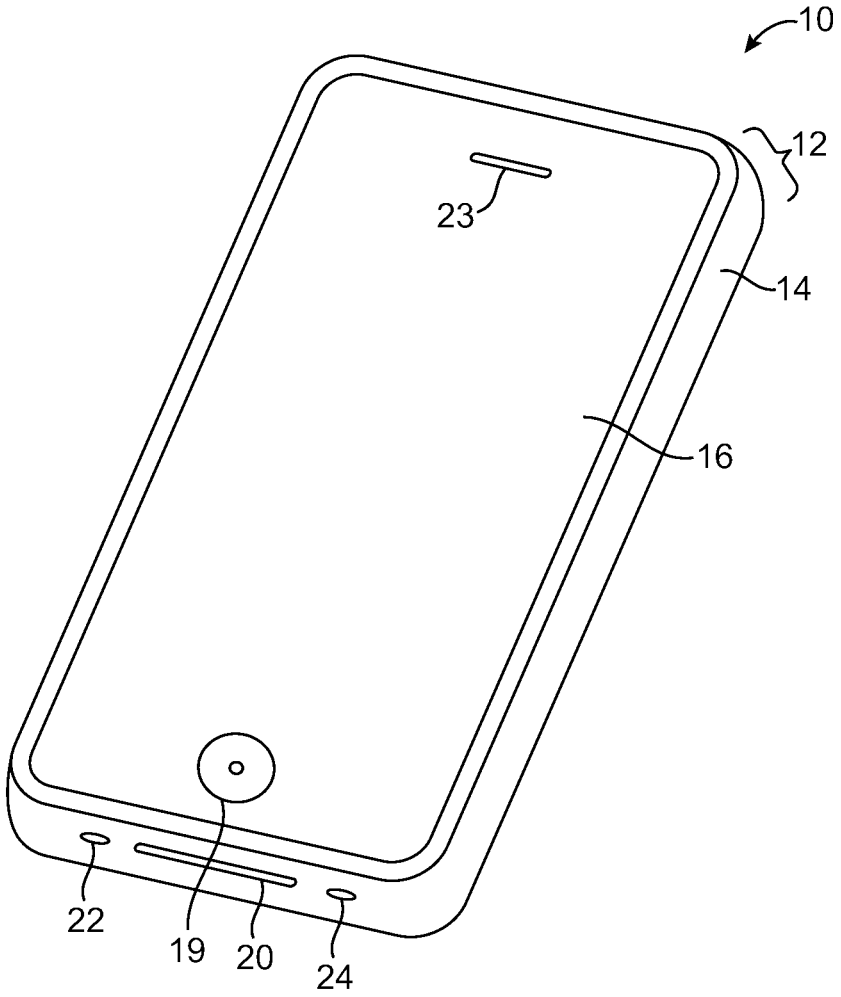
FIG. 1 is a perspective view of an illustrative portable electronic device in accordance with an embodiment of the present invention.

An illustrative portable electronic device in accordance with an embodiment of the present invention is shown in FIG. 1. Device 10 of FIG. 1 may be, for example, a handheld electronic device that supports 2G and/or 3G cellular telephone and data functions, global positioning system capabilities, and local wireless communications capabilities (e.g., IEEE 802.11 and Bluetooth®) and that supports handheld computing device functions such as internet browsing, email and calendar functions, games, music player functionality, etc.

Device 10 may have housing 12. Housing 12, which is sometimes referred to as a case, may be formed of any suitable materials including, plastic, glass, ceramics, metal, or other suitable materials, or a combination of these materials. In some situations, housing 12 or portions of housing 12 may be formed from a dielectric or other low-conductivity material, so that the operation of conductive antenna elements that are located in proximity to housing 12 is not disrupted. As an example, planar front and rear surfaces may be formed from dielectric or all or some of the sidewalls of housing 12 may be formed from dielectric. Housing 12 or portions of housing 12 may also be formed from conductive materials such as metal. For example, a conductive rear portion may cover all or part of the rear planar surface of housing 12. All or part of the sidewalls of housing 12 may also be formed from conductive materials such as metal. Metal structures may be formed from elemental metals (e.g., aluminum with or without an oxide coating) or from metal alloys (e.g., stainless steel). An advantage of forming all or part of housing 12 from a dielectric material such as plastic is that this may help to reduce the overall weight of device 10. An advantage of forming all or part of housing 12 from a conductive material such as metal is that metal is durable and, if an antenna is designed properly, the conductive nature of the housing may be exploited by using portions of the housing itself to form the antenna. In an antenna slot configuration, for example, all or some of the slot may be defined by portions of housing 12.

Other components in device 10 may also be used in defining the shape of a slot antenna. For example, conductive device components such as batteries, printed circuit boards, circuits, radio-frequency shielding enclosures for integrated circuits, switches, and flexible printed circuit board structures ("flex circuits"), display structures, speakers, and other conductive structures may impact antenna performance and may help to define the shape of a slot antenna in device 10.

Housing 12 may have a conductive structure 14 that helps form the sidewall portions of housing 14. Conductive sidewall structure 14 may be formed from a separate conductive member such as a rectangular metal ring or may be formed as an integral portion of other housing structures. For example, the rear surface of housing 12 may be formed from the same piece of metal that is used in forming sidewalls 14. If desired, multiple structures may be connected to each other to form sidewall structure 14. All or some of sidewalls 14 may surround display 16. In this respect, some or all of the structures associated with sidewalls 14 may serve as a bezel. This type of bezel and other suitable bezel structures for device 10 may be formed from a conductive material and may be used as part of the antennas in device 10. For example, sidewall 14 may be used to define part of the inner perimeter shape for a slot in a slot antenna. Slot antennas may also be formed within internal structures in device 10 (i.e., in printed circuit boards, etc.).

Device 10 may have a display such as display 16. Display 16 may be a liquid crystal display (LCD), an organic light-emitting diode (OLED) display, a plasma display, an electronic ink display, or any other suitable display. The outermost surface of display 16 may be formed from one or more plastic or glass layers. If desired, touch screen functionality may be integrated into display 16. An advantage of integrating a touch screen into display 16 to make display 16 touch sensitive is that this type of arrangement can save space and reduce visual clutter. Touch screen displays such as display 16 may be formed from capacitive touch sensors or any other suitable touch sensors (e.g., resistive touch sensors, touch sensors based on light or sound waves, etc.). An advantage of capacitive touch sensors is that they may be used to sense the presence of an object even when the object is not in direct contact with display 16.

Display screen 16 (e.g., a touch screen) is merely one example of an input-output device that may be used with electronic device 10. If desired, electronic device 10 may have other input-output devices. For example, electronic device 10 may have user input control devices such as button 19, and input-output components such as port 20 and one or more input-output jacks (e.g., for audio and/or video). Button 19 may be, for example, a menu button. Port 20 may contain a 30-pin data connector (as an example). Openings 22 and 24 may, if desired, form speaker and microphone ports. Speaker port 22 may be used when operating device 10 in speakerphone mode. Opening 23 may also form a speaker port. For example, speaker port 23 may serve as a telephone receiver that is placed adjacent to a user's ear during operation. In the example of FIG. 1, display screen 16 is shown as being mounted on the front face of handheld electronic device 10, but display screen 16 may, if desired, be mounted on the rear face of handheld electronic device 10, on a side of device 10, on a flip-up portion of device 10 that is attached to a main body portion of device 10 by a hinge (for example), or using any other suitable mounting arrangement.

A user of electronic device 10 may supply input commands using user input interface devices such as button 19 and touch screen 16. Suitable user input interface devices for electronic device 10 include buttons (e.g., alphanumeric keys, power on-off, power-on, power-off, and other specialized buttons, etc.), a touch pad, pointing stick, or other cursor control device, a microphone for supplying voice commands, or any other suitable interface for controlling device 10. Although shown as being formed on the top face of electronic device 10 in the example of FIG. 1, buttons such as button 19 and other user input interface devices may generally be formed on any suitable portion of electronic device 10.

Components such as display 16 and other user input interface devices may cover most of the available surface area on the front face of device 10 (as shown in the example of FIG. 1) or may occupy only a small portion of the front face of device 10. Because electronic components such as display 16 often contain large amounts of metal (e.g., as radio-frequency shielding), the location of these components relative to the antenna elements in device 10 should generally be taken into consideration. It is generally desirable to maximize the amount of space available for components in device 10, while avoiding layouts that make the size of device 10 unnecessarily large.

In accordance with embodiments of the present invention, slot antenna structures may be formed to cover one or more communications bands of interest. The slots in the slot antennas may be routed around conductive components such as display 16 in a way that helps maximize internal space for components in device 10 while meeting desired performance criteria.

Figure 2:
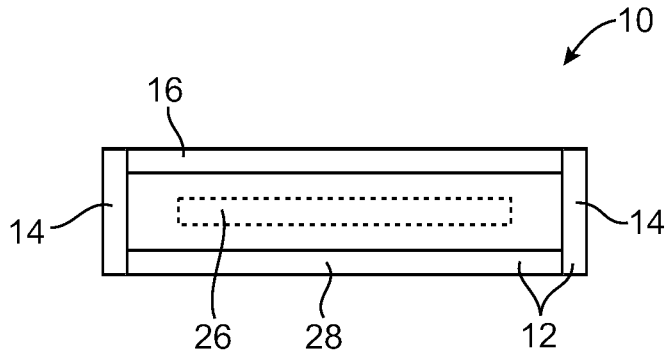
FIG. 2 is a cross-sectional view of a portable electronic device showing how the device may be provided with conductive sidewalls in accordance with an embodiment of the present invention.

A cross-sectional end view of an illustrative device is shown in FIG. 2. As shown in FIG. 2, device 10 may have a display such as display 16 that is mounted in a housing such as housing 12. Housing 12 may have sidewalls 14 and a rear planar housing structure 28. Internal components 26 may be mounted within device 10. Components 26 may include, for example, a battery, one or more printed circuit boards, and circuitry mounted to the printed circuit boards. A slot antenna in device 10 may be formed using the gap between sidewalls 14 and internal components 26.

In the FIG. 2 example, rear housing surface 28 is shown as being formed from a separate member than housing walls 14. This type of arrangement may use, for example, a metal plate that is mounted within a ring-shaped metal sidewall member 14. Sidewall member 14 may, for example, be a ring of metal that follows the outer perimeter of device 10 and that has a height of about 7 to 9 mm (as an example).

Figure 3:
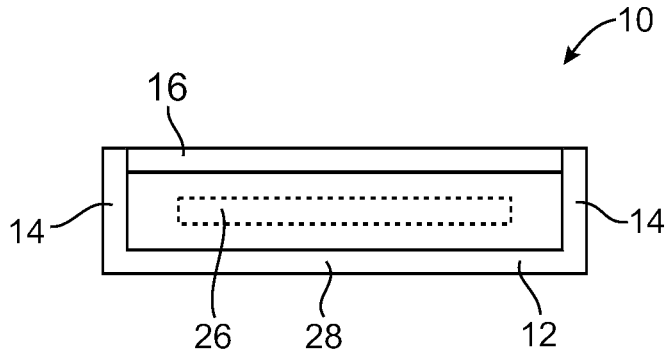
FIG. 3 is a cross-sectional view of a portable electronic device showing how a housing for the device may have conductive sidewalls and a conductive rear housing portion in accordance with an embodiment of the present invention.

If desired, sidewalls 14 may be formed as an integral portion of housing 12. This type of arrangement is shown in FIG. 3. As shown in the example of FIG. 3, housing 12 may have sidewalls 14 and a rear portion such as rear planar portion 28 that are formed as a unitary housing structure. As with the arrangement of FIG. 2, slot antenna structures can be formed from the gap between housing 12 and components 26. In particular, in both the FIG. 2 and FIG. 3 configurations, the inner surfaces of sidewalls 14 or other housing surfaces may, at least partly, define the location of the slot for a slot antenna. The opposing outer edges of components 26 may also help to define the location of the slot for the slot antenna. Slot shapes can also be defined by using openings in conductive traces on printed circuit boards, using other housing structures, and using other conductive members. The examples of FIGS. 2 and 3 are merely illustrative.

Figure 4:
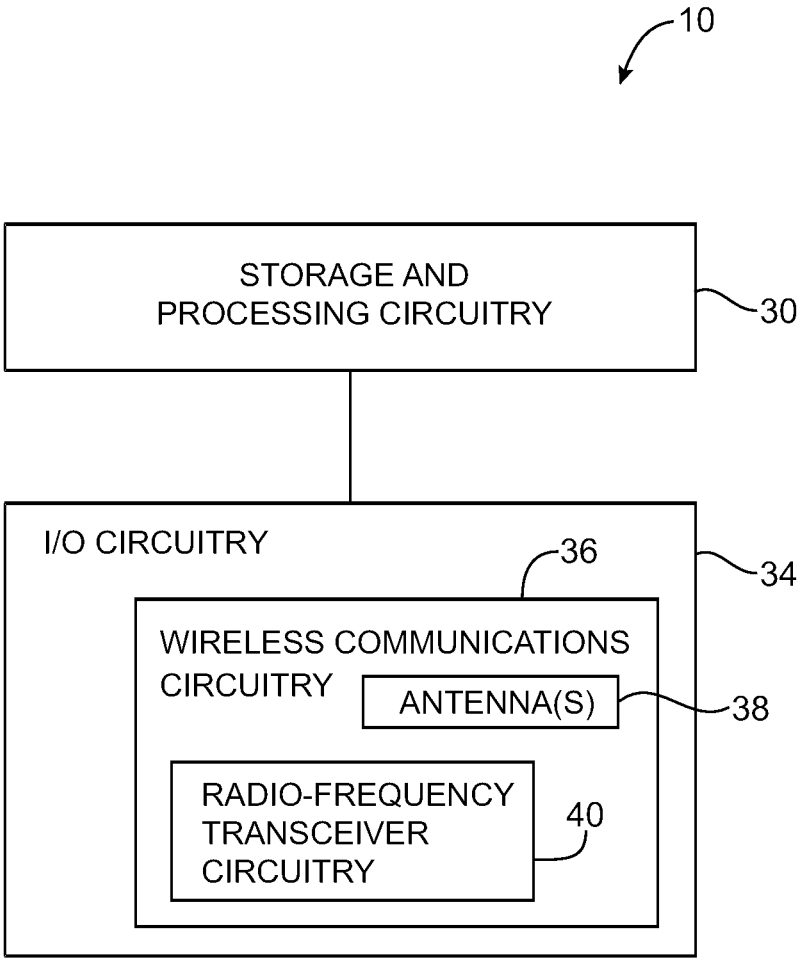
FIG. 4 is a diagram of an illustrative circuitry that may be used in an electronic device in accordance with an embodiment of the present invention.

A schematic diagram of illustrative circuitry that may be used in device 10 is shown in FIG. 4. As shown in FIG. 4, device 10 may have storage and processing circuitry 30 that is used in controlling the operation of device 10. Circuitry 30 may include one or more different types of storage such as hard disk drive storage, nonvolatile memory (e.g., flash memory or other electrically-programmable-read-only memory), volatile memory (e.g., static or dynamic random-access-memory), etc. Processing circuitry in circuitry 30 may be based on a processor such as a microprocessor and other suitable integrated circuits. With one suitable arrangement, storage and processing circuitry 30 may be used to run software on device 10 such as applications and operating system components. The software may be used in implementing communications protocols such as wireless local area network protocols (e.g., IEEE 802.11 protocols—sometimes referred to as Wi-Fi®), protocols for other short-range wireless communications links such as the Bluetooth® protocol, protocols for handling 3G communications services (e.g., using wide band code division multiple access techniques), 2G cellular telephone communications protocols, etc.

Device 10 may have input-output circuitry 34. Input-output circuitry 34 may be used to allow data to be supplied to device 10 and may be used to allow data to be provided from device 10 to external devices. Display screen 16, button 19, microphone port 24, speaker port 22, and dock connector port 20 of FIG. 1 are examples of input-output circuitry 34.

Input-output circuitry 34 may also include user input-output devices such as buttons, touch screens, joysticks, click wheels, scrolling wheels, touch pads, key pads, keyboards, microphones, cameras, etc. A user can control the operation of device 10 by supplying commands through circuitry 34.

Wireless communications circuitry 36 may include one or more antennas 38 and communications circuitry such as radio-frequency (RF) transceiver circuitry 40. Circuitry 36 may be used in transmitting and receiving radio-frequency signals and may be formed from one or more integrated circuits, power amplifier circuitry, passive RF components, and other circuitry for handling RF wireless signals.

Any suitable antenna structures may be used in device 10. For example, device 10 may have one antenna or may have multiple antennas. If multiple antennas are used, slot antennas and other antenna types may be used in device 10. The antennas in device 10 may each be used to cover a single communications band or each antenna may cover multiple communications bands. If desired, one or more antennas may cover a single band while one or more additional antennas are each used to cover multiple bands.

In arrangements in which antennas are needed to support communications at more than one band, the antennas may have shapes that support multi-band operations. For example, slot antenna may have a slot with one or more arms of various different lengths. The antenna slots in device 10, may, if desired, be combined with other antenna structures in device 10. For example, hybrid antenna structures may be formed by combining antenna slots with other antenna resonating element antenna structures such as inverted-F antenna elements, planar inverted-F antenna elements, strip antennas, patch antennas, etc.

A slot antenna may be formed from a conductive structure that contains an opening that forms a slot. The opening may be filled with a dielectric. The conductive structure that surrounds the opening may be formed from one or more conductive elements (e.g., rigid and flexible printed circuit board structures, conductive housing portions, conductive portions of device components, etc.). The opening in the conductive portion of the slot antenna may be filled with a dielectric such as air or a solid dielectric such as plastic or epoxy.

An advantage of filling the opening with a solid dielectric material is that this may help prevent intrusion of dust, liquids, or other foreign matter that might affect antenna performance. When an opening is formed from a conductor on a flex circuit, the opening may be filled with or placed on top of flex circuit material (polyimide). Similarly, when slot antenna openings are formed from rigid printed circuit board traces, the dielectric within the openings or immediately adjacent to the openings is composed of printed circuit board dielectric (e.g., fiberglass-filled epoxy). Dielectrics such as these may also be used in support structures for antenna elements (e.g., when supporting a flex circuit antenna element), or may be used in surrounding device structures in which it is desired not to block radio-frequency signals.

In general, any suitable dielectric material can be used as an antenna support and any suitable dielectric can be used to fill the openings associated with the slot antennas. The dielectric material may be, for example, a solid dielectric, a porous dielectric, a foam dielectric, a gelatinous dielectric (e.g., a coagulated or viscous liquid), a dielectric with grooves or pores, a dielectric having a honeycombed or lattice structure, a dielectric having spherical voids or other voids, a combination of such non-gaseous dielectrics, etc. The dielectric material can also be a gaseous dielectric such as air. Hollow features in solid dielectrics may be filled with air, other gases, or other low-dielectric-constant materials. For example, dielectrics such as epoxy and polyimide may be provided with voids such as gas bubbles or low-dielectric-constant microspheres. Porous dielectric materials used in device 10 can be formed with a closed cell structure (e.g., with isolated voids) or with an open cell structure (e.g., a fibrous structure with interconnected voids). Foams such as foaming glues (e.g., polyurethane adhesive), pieces of expanded polystyrene foam, extruded polystyrene foam, foam rubber, or other manufactured foams can also be used. If desired, the dielectric materials that are used in supporting the antennas and that are used in filling the slot openings of the antennas can include layers or mixtures of different substances such as mixtures including small bodies of lower density material. Slot antenna arrangements in which the openings in the slots are filled with air are sometimes described herein as an example. Air-filled slots are, however, merely one illustrative type of dielectric-filled slot that may be used for the slot antennas of devices such as device 10.

Figure 5:
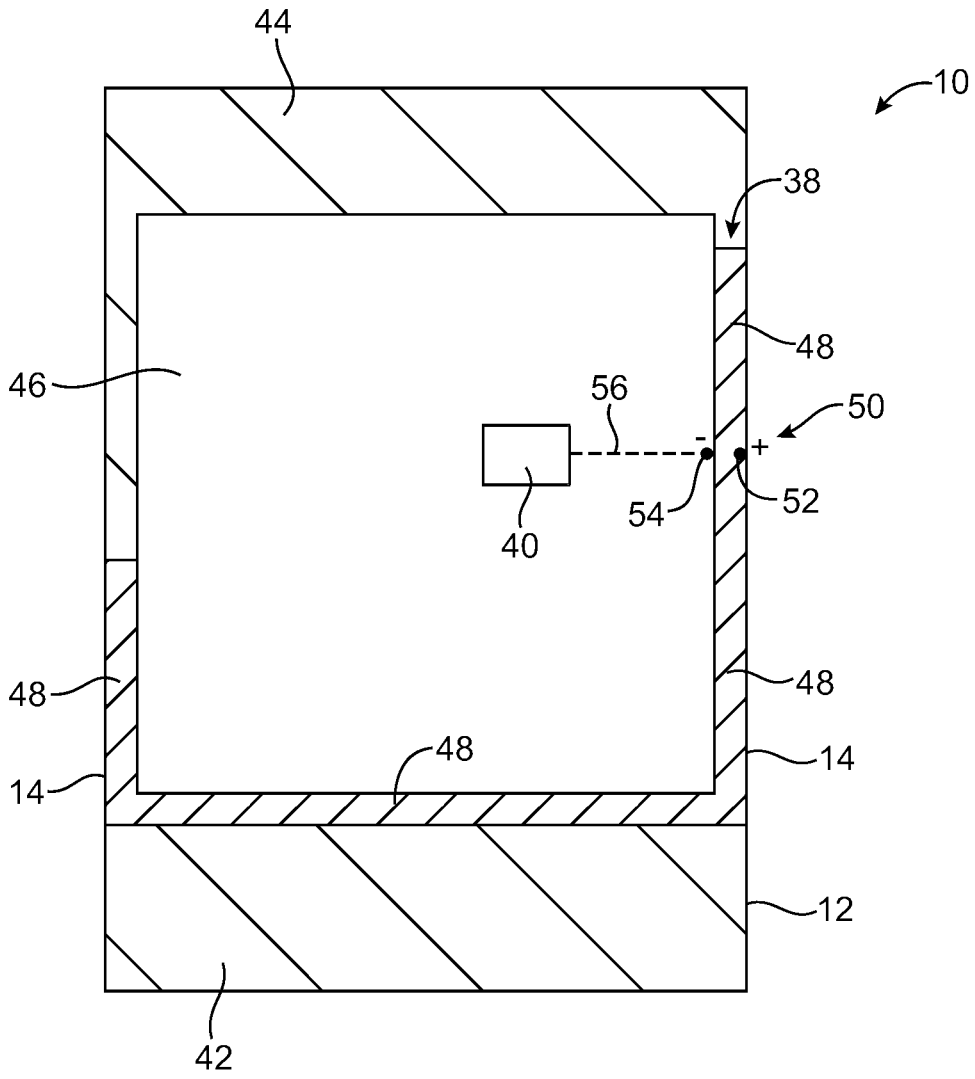
FIG. 5 is a top view of an interior portion of an electronic device having a slot antenna in accordance with an embodiment of the present invention.

An illustrative slot antenna 38 is shown in FIG. 5. In the example of FIG. 5, slot antenna 38 has slot opening 48. The shape of slot opening 48 is defined by surrounding conductive structures such as housing 12 (i.e., parts of housing sidewalls 14), and conductive structures 42, 46, and 44. Conductive structure 46 may, for example, be associated with a conductive printed circuit board structure, a battery, a display such as display 16, etc. Conductive structure 42 may, for example, be associated with electrical components such as a flex circuit communications path, a port connector, a speaker, and other device components. Conductive structure 44 may be formed from conductive device structures such as speaker parts, a camera, buttons, etc. These are merely illustrative examples. Conductive structures such as conductive structures 42, 46, and 44 and housing 12 and its sidewalls 14 or any other suitable conductive structures may be used in defining the shape of opening 48 in slot antenna 38.

Antenna 38 may be fed using any suitable antenna feed arrangement. In the example of FIG. 5, antenna 38 has a feed with two antenna feed terminals. As shown in FIG. 5, antenna feed 50 may have a first antenna feed terminal such as feed terminal 52 that is connected to a first portion of the conductive structures surrounding opening 48. Antenna feed 50 may also have a second feed such as feed terminal 54 that is connected to a second portion of the conductive structures surrounding opening 48. Feed terminals 52 and 54 may be located on opposite sides of slot 48. Terminal 52 may be a ground antenna feed terminal and terminal 54 may be a positive antenna feed terminal (as examples).

A radio-frequency transmission line path such as path 56 may be used to route radio-frequency signals between radio-frequency transceiver 40 and feed 50. Paths such as path 56 that are used to route signals between transceiver 40 may include impedance matching networks, components such as switches, etc. Path 56 may be based on transmission line structures such as microstrip transmission lines, coaxial cables, etc. Transceiver circuitry 40 may include one or more integrated circuits that are mounted on one or more printed circuit boards. Structures such as transceiver 40, path 56, and feed 50 are sometimes not shown to avoid over-complicating the drawings.

As the diagram of FIG. 5 illustrates, the use of a slot antenna in device 10 leaves space for numerous components in device 10. Space can be used efficiently by using the inner portions of sidewalls 14 and the edges of structures such as printed circuit board structures to define the slot edges. This type of arrangement can therefore help to minimize wasted space in device 10.

Figure 6:
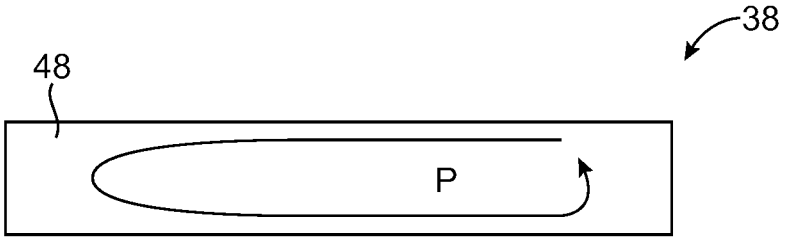
FIG. 6 is a diagram of an illustrative rectangular slot antenna showing how the length of the inner perimeter of the slot can be measured in accordance with an embodiment of the present invention.
Figure 7:
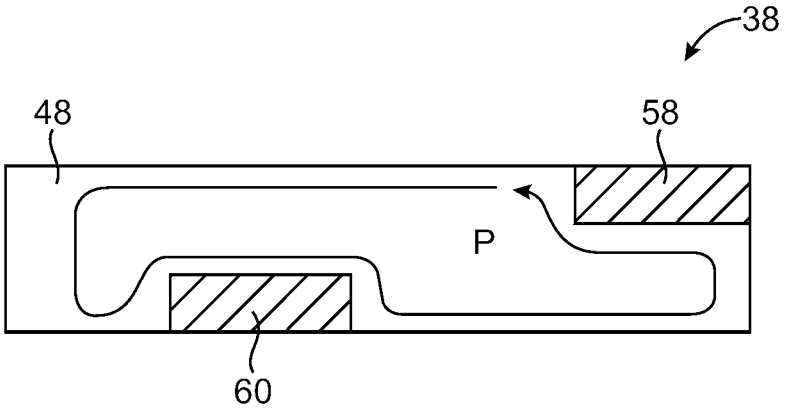
FIG. 7 is a diagram of an illustrative slot antenna showing how the length of the inner perimeter of the slot can be influenced by overlapping conductive components or other irregular conductive features in accordance with an embodiment of the present invention.

The shape of the slot and the location of the slot feed may be selected to adjust the frequency response of the antenna. The width of the slot may be, for example, 0.5 to 10 mm and the length of the slot may be, for example, 2-25 cm (as an example). As shown in FIG. 6, a slot antenna such as slot antenna 38 may have an opening (slot) such as opening 48 that has a perimeter P. Slot antenna 38 will tend to exhibit good antenna efficiency (i.e., the antenna will resonate in a fundamental frequency) when handling radio-frequency signals that have a wavelength equal to perimeter P. As shown in FIG. 7, this principal applies even if the shape of slot opening 48 is irregular. In the FIG. 7 example, conductive components 58 and 60 have intruded into the otherwise rectangular shape of slot 48, thereby altering the length of slot perimeter P. This will affect the frequency response of antenna 38 (i.e., by increasing its fundamental resonating wavelength and thereby decreasing its fundamental resonating frequency).

Figure 8:
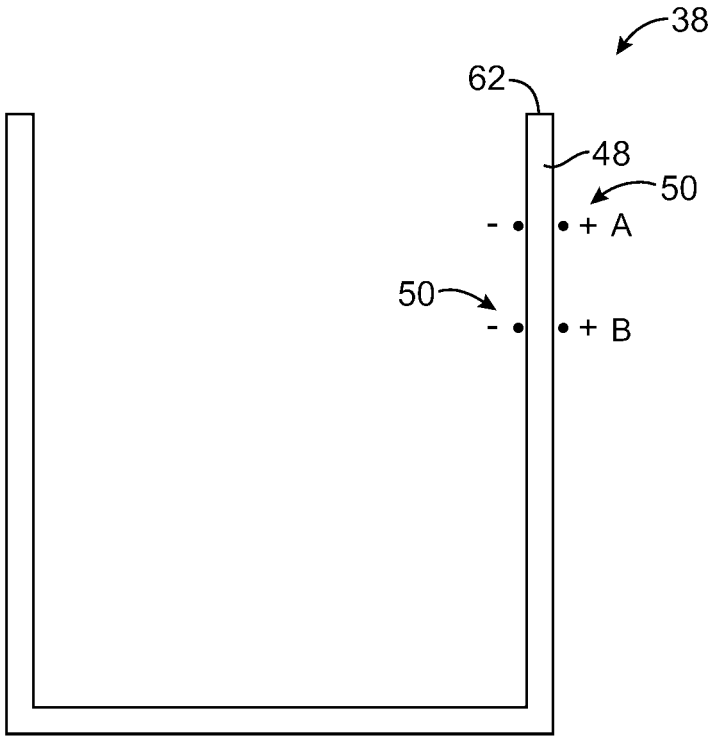
FIG. 8 is an illustrative slot antenna with symmetric branches in accordance with an embodiment of the present invention.

The location of feed 50 along the length of slot 48 affects antenna performance. Consider, as an example, antenna 38 of FIG. 8. There are two possible locations for antenna feed 50 in the example of FIG. 8. In location A, feed 50 is located closer to end 62 of slot 48 and farther from the center of slot 48 than in location B. As a result, the antenna feed in position B will tend to couple to more harmonic frequencies in antenna 38 than the antenna feed in position A.

Figure 9:
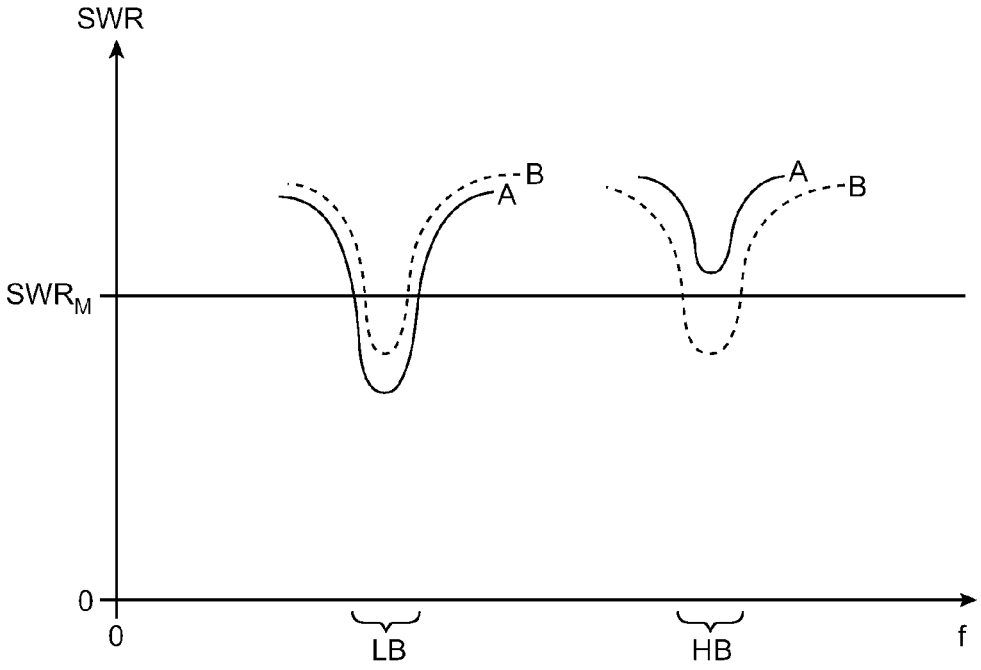
FIG. 9 is a graph showing how the location of the antenna feed in a slot antenna may influence antenna performance in accordance with an embodiment of the present invention.

The frequency response of antenna 38 when using antenna feed positions A and B is shown in FIG. 9. In the graph of FIG. 9, standing wave ratio (SWR) performance is plotted as a function of operating frequency f. The dip in SWR values that is shown in FIG. 9 corresponds to frequencies at which antenna 38 is operating efficiently and is able to transmit and receive radio-frequency signals. The frequency of low band LB is associated with the fundamental frequency of antenna 38 and may be adjusted by adjusting the perimeter P of slot 48, as described in connection with FIGS. 6 and 7.

An antenna with a SWR value that is below a given minimum standing-wave-ratio value $SWR_M$ in both low band LB and high band HB of FIG. 9 is considered to exhibit acceptable performance (in this example). When feed location A is used, antenna performance is satisfactory in low band LB, but is not satisfactory in high band HB. This is because the harmonic frequencies of the antenna were insufficiently stimulated when using the feed in position A. In feed position B, however, additional harmonics of the fundamental resonant frequency associated with slot 48 contribute to the antenna performance characteristic. The additional antenna efficiency that is created in high band HB ensures that the antenna response in high band HB will be acceptable. Although this tends to reduce the antenna response in low band LB somewhat, performance in low band LB is still acceptable.

As this example demonstrates, proper selection of the feed location (i.e., feed location B) and the slot shape (e.g., to produce a perimeter P that creates a fundamental resonance at a suitable frequency) may make it possible to satisfy performance criteria in all communications bands of interest.

Figure 10:
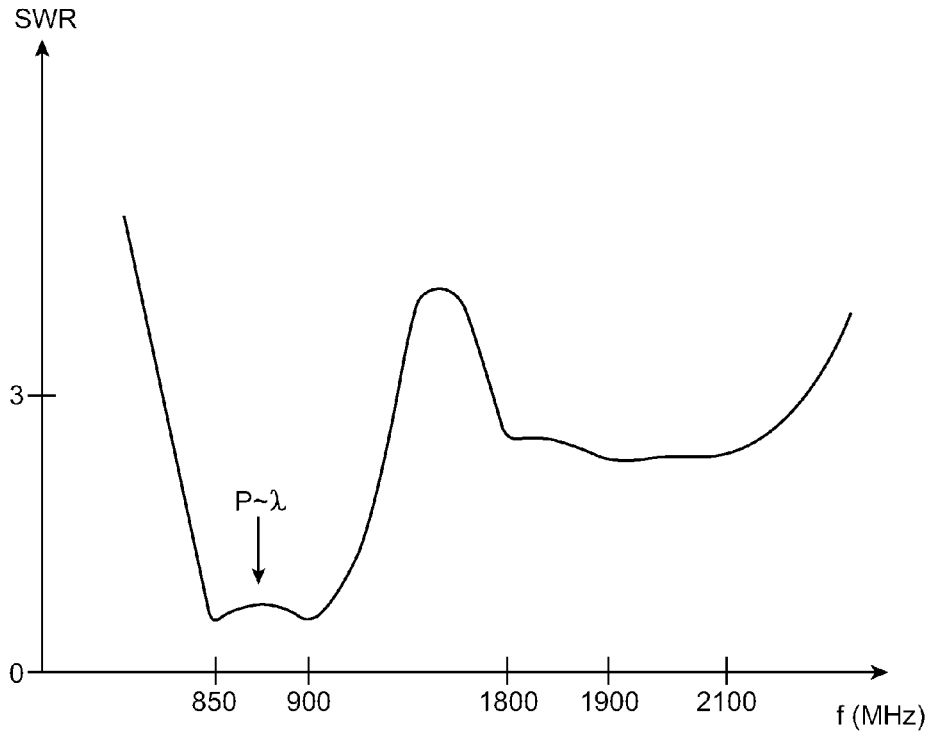
FIG. 10 is a graph showing how a slot antenna may cover five cellular telephone communications bands in accordance with an embodiment of the present invention.

In general, any suitable number of communications bands may be covered by antenna 38 in this way. FIG. 10 shows how five communications bands may be covered by proper selection of the perimeter P and feed location. The bands being covered in this example are the cellular telephone bands at 850 MHz, 900 MHz, 1800 MHz, 1900 MHz, and 2100 MHz. As shown in the graph of FIG. 10, the perimeter P of slot 48 can be adjusted to coincide with the wavelength λ at the approximate midpoint of the low bands at 850 MHz and 900 MHz. The antenna feed may be located at a position such as position B of FIG. 8 in which a sufficient harmonic response is generated to extend the high band coverage of the antenna over the bands at 1800 MHz, 1900 MHz, and 2100 MHz.

More bands or fewer bands may be covered if desired. Moreover, different bands at different frequencies may be covered. The illustrative pentaband slot antenna arrangement of FIG. 10 is merely an example.

Figure 11:
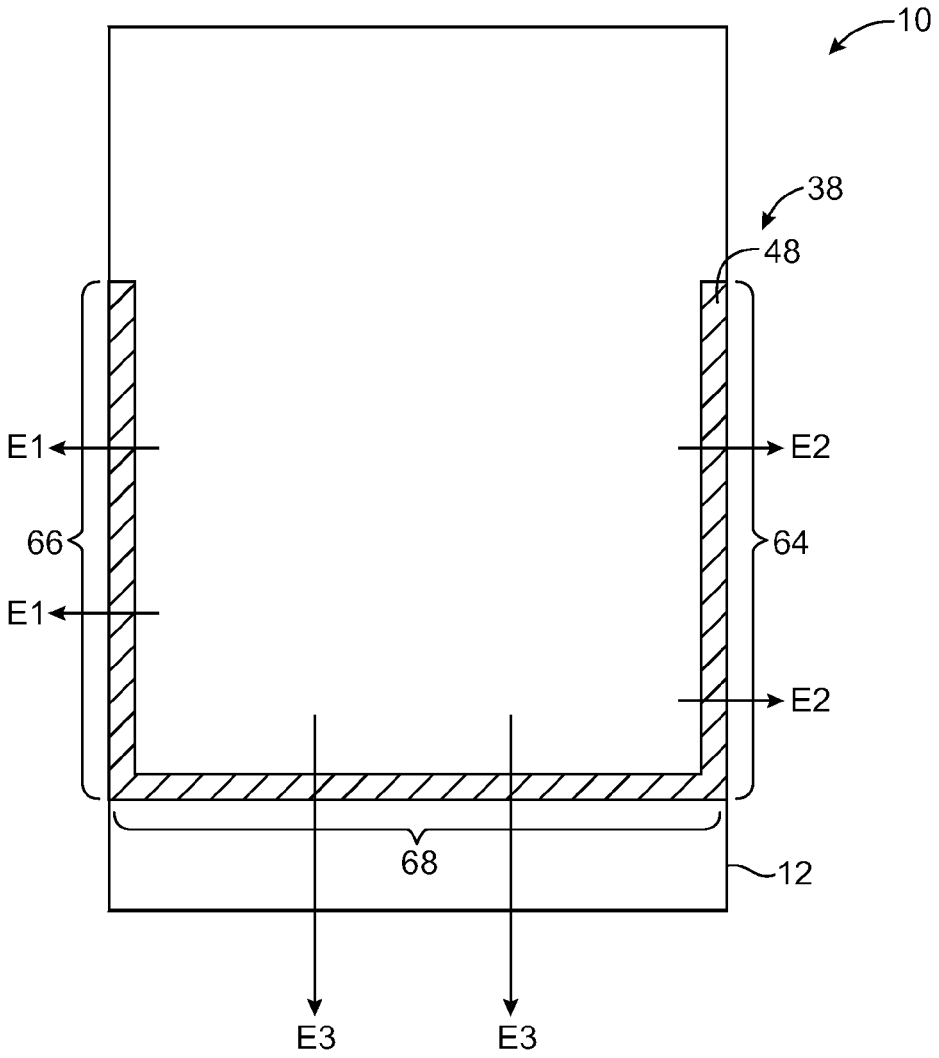
FIG. 11 is a top view of an illustrative symmetric slot antenna showing how electromagnetic fields may interact during operation in accordance with an embodiment of the present invention.

Slot 48 may be formed in a symmetrical or asymmetrical shape. In a typical symmetrical arrangement, slot 48 may be laid out in a roughly U-shaped arrangement. As shown in FIG. 11, slot 48 may have two elongated vertical arms 64 and 66 that are connected by a horizontal portion 68. Antenna slot 48 of FIG. 11 may be referred to as using a symmetrical layout, because antenna arms 64 and 66 are substantially equal in size and shape and are located in mirrored positions. As a first approximation, arms 64 and 66 may, during operation of the antenna, have associated electric fields E1 and E2 that cancel each other. The directional characteristic of antenna 38 may therefore be dominated by electric field component E3, which is oriented downwards away from the center of device 10. This electric field orientation and resulting radiation pattern for device 10 may help ensure regulatory compliance for radiation emission levels. In an actual device 10 that contains numerous conductive components, the electromagnetic field patterns associated with antenna 38 will generally be more complex than illustrated in FIG. 11. Nevertheless, the diagram of FIG. 11 shows how electromagnetic field directivity may be influenced by the location and shape of antenna slot features.

Figure 12:
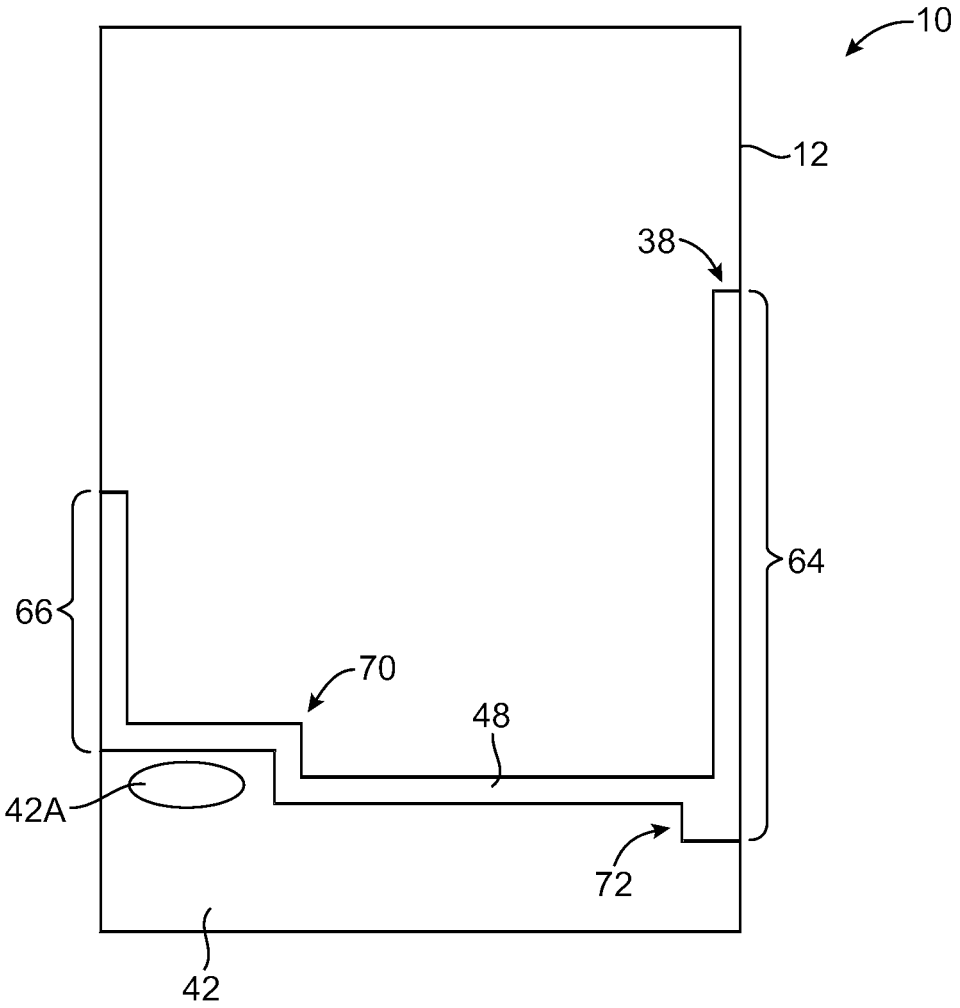
FIG. 12 is top view of an illustrative slot antenna with bends and a short branch in accordance with an embodiment of the present invention.
Figure 13:
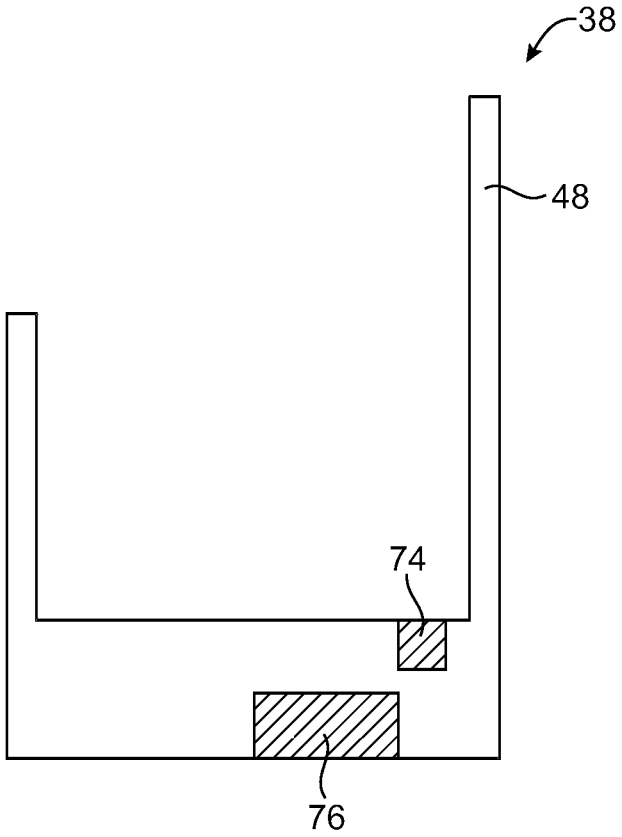
FIG. 13 is top view of an illustrative slot antenna having an inner perimeter whose length is dictated partly by the position of adjacent conductive components in accordance with an embodiment of the present invention.

An illustrative asymmetrical shape that may be used for slot 48 of antenna 38 is shown in FIG. 12. As shown in FIG. 12, elongated rectangular arms 66 and 64 of slot 48 have different lengths in an asymmetrical slot layout. The example of FIG. 12 also demonstrates how slot 48 may have irregular shape features such as bend 70 and widened stub portion 72. Bends such as bend 70 may be made to accommodate electrical components such as components in region 42A of components region 42. Widened portions such as portion 72 may be used to influence antenna bandwidth. Wider slot structures tend to exhibit larger bandwidths than narrower slot structures, so when an enlarged bandwidth is required, relatively wider slot shapes such as widened portion 72 may be included in slot 48. As shown in FIG. 13, bends may be produced in slot 48 by overlapping conductive components such as components 74 and 76. Components 74 and 76 may be conductive members or electrical components in device 10 such as switches, buttons, speakers, flex circuit structures, printed circuit structures, housing portions, etc.

Bends, widened portions, and other irregular shapes can be incorporated into slot 48 to tune the frequency response of antenna 48. Each portion of an irregularly shaped slot antenna may contribute to the antenna's performance. For example, short sections of a slot may behave as impedance matching structures. When combined in slot 48, the resulting antenna performance may exhibit resonances at desired wavelengths. Multiple arms and stubs (short arms) may also be provided to enhance resonances at multiple wavelengths of interest.

Figure 14:
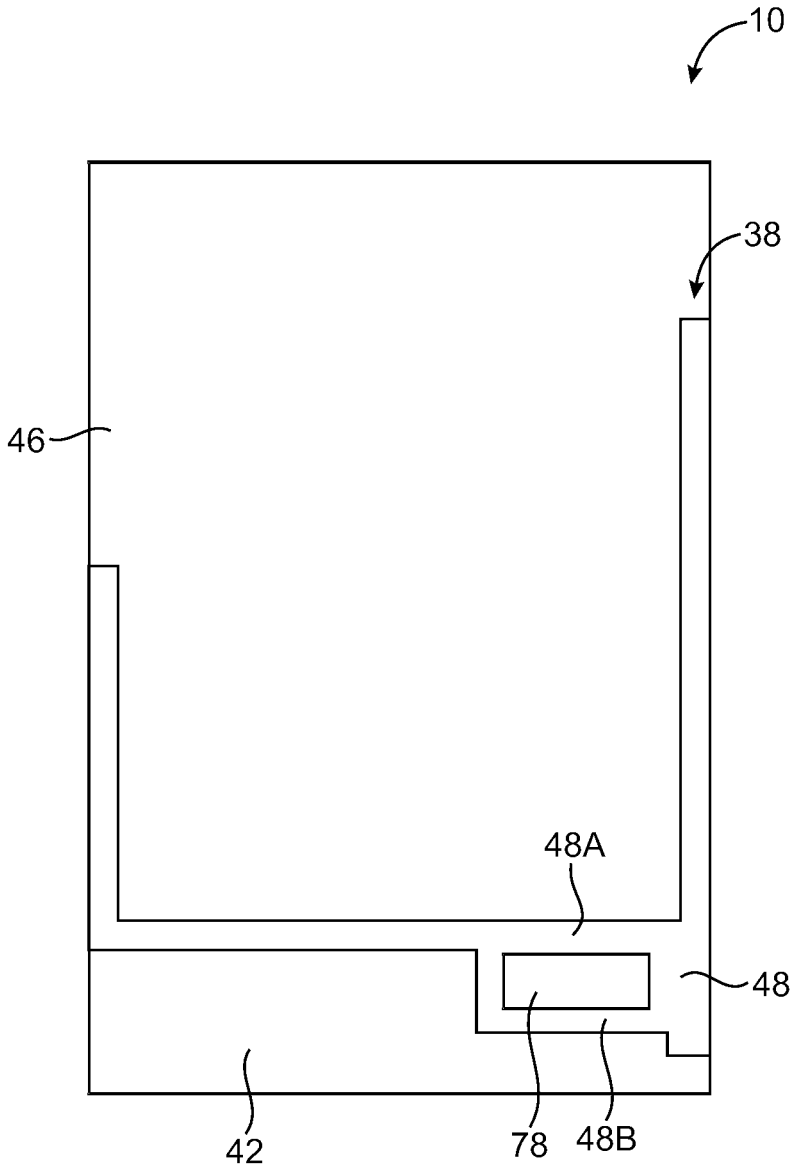
FIG. 14 is a top view of an illustrative slot antenna in which a conductive component or other conductive structure forms an island within the confines of the slot opening in the slot antenna in accordance with an embodiment of the present invention.

FIG. 14 shows how one or more conductive regions such as conductive region 78 may be located in the interior of slot 48. This type of arrangement creates slot branch paths such as branch paths 48A and 48B and may add a capacitive loading component to the antenna that help reduce overall slot length requirements for a given operating frequency. The use of island-type conductive structures such as region 78 that are completely surrounded by slot 48 produces two effective lengths for the slot such as a first length L1 that includes path 48A and a second length L2 that includes path 48B. Because lengths L1 and L2 are different, the inclusion of conductive region 78 may influence the frequency response of the antenna (e.g., by creating a wider bandwidth for antenna 38 in some of its operating bands). Conductive regions such as region 78 may be produced by incorporating a conductive structural member or other conductive materials into slot 48 or may be produced by including electrical components in slot 48. As an example, a speaker that contains conductive structures may be placed in slot 48 in region 78, thereby producing branch paths 48A and 48B and introducing capacitive loading to antenna 38.

Figure 15:
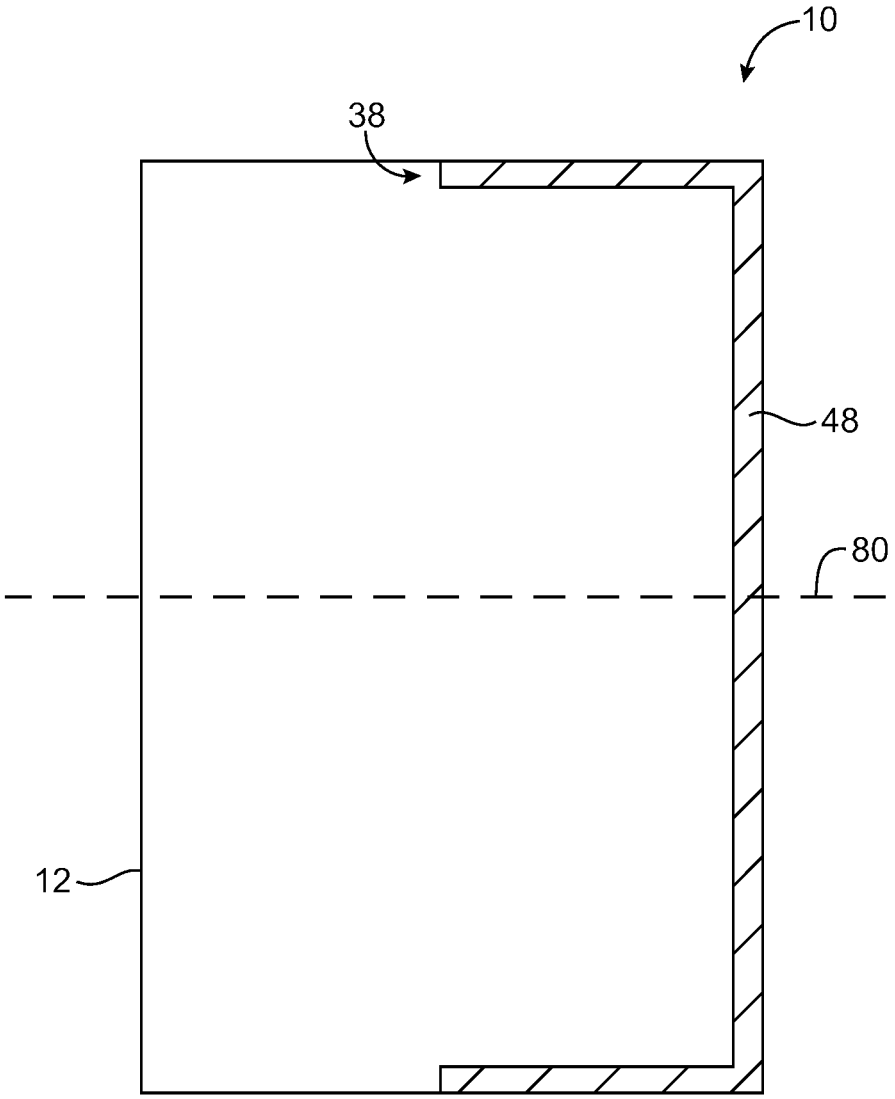
FIG. 15 is a top view of an illustrative slot antenna that has elongated rectangular branches along the upper and lower edges of a handheld electronic device in accordance with an embodiment of the present invention.

If desired, slot 48 may exhibit mirror symmetry with respect to horizontal axis 80 of device 10, as shown in FIG. 15. This type of arrangement may be used to accommodate components that run along one of the sides of housing 12 (i.e., to accommodate conductive structures that run along the left-hand edge of housing 12 in the FIG. 15 example). Asymmetrical slots 48 may also be used that have arms with longitudinal axes that run along the upper and lower edges of housing 12.

Figure 16:
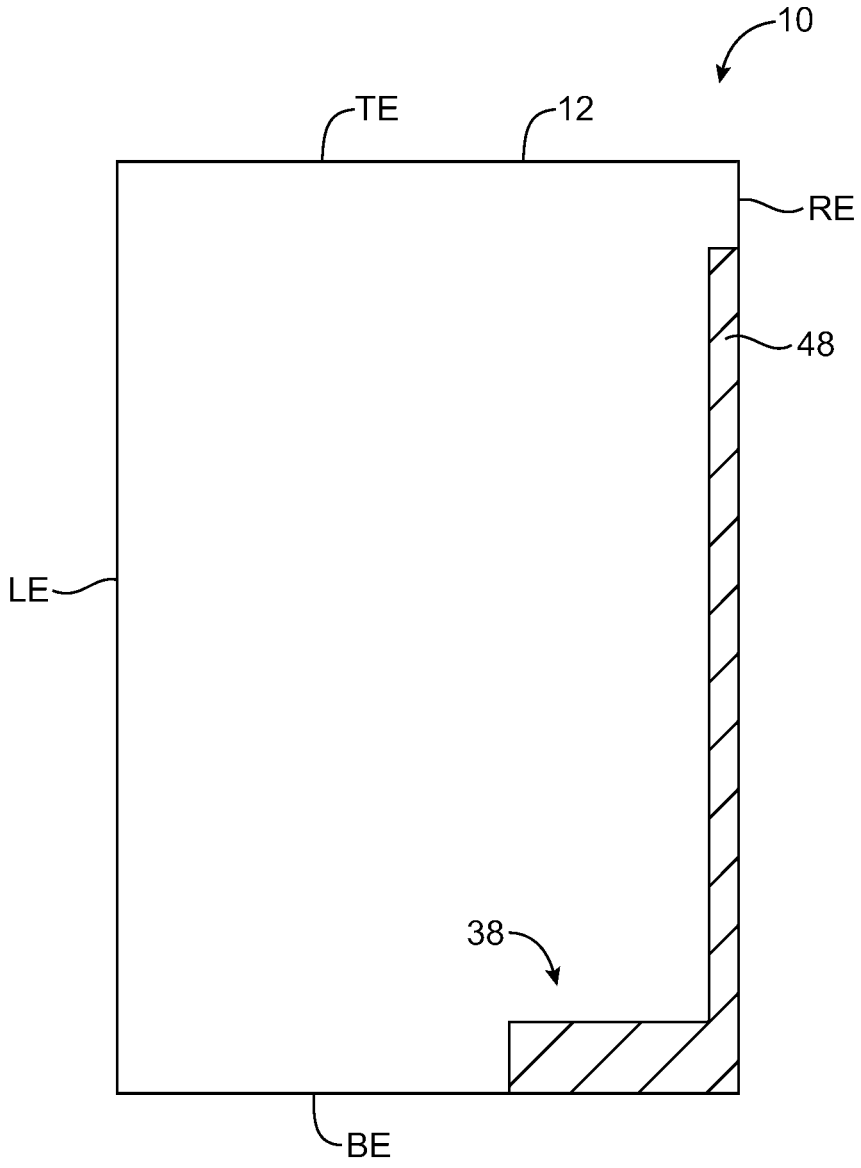
FIG. 16 is top view of an illustrative slot antenna that is formed along a side and partly along the bottom portion of a handheld electronic device in accordance with an embodiment of the present invention.

Another possible layout for antenna 38 is shown in FIG. 16. As shown in FIG. 16, antenna 38 need not have a "U" shape. Rather, antenna slot 48 may have an "L" shape or other suitable shape. An advantage of an "L" shape of the type shown in FIG. 16 is that this allows conductive components to be mounted within device 10 that are adjacent to some or all of three edges of housing 12. In the FIG. 16 example, conductive components can be placed adjacent to all of top edge TE, can be placed adjacent to all of left edge LE, and can be placed adjacent to some of right edge RE and bottom edge BE. In general, L-shaped slots may be formed so that both arms of the L are adjacent to housing edges, so that one arm of the L is adjacent to a housing edge, or so that both arms of the L are mounted within the interior of device 10. The example of FIG. 16 in which slot 48 is formed using the right-hand and bottom edges of housing 12 is merely illustrative. Slot 48 of FIG. 16 and the other FIGS. may be placed adjacent to any of the edges of housing 12 if desired.

Figure 17:
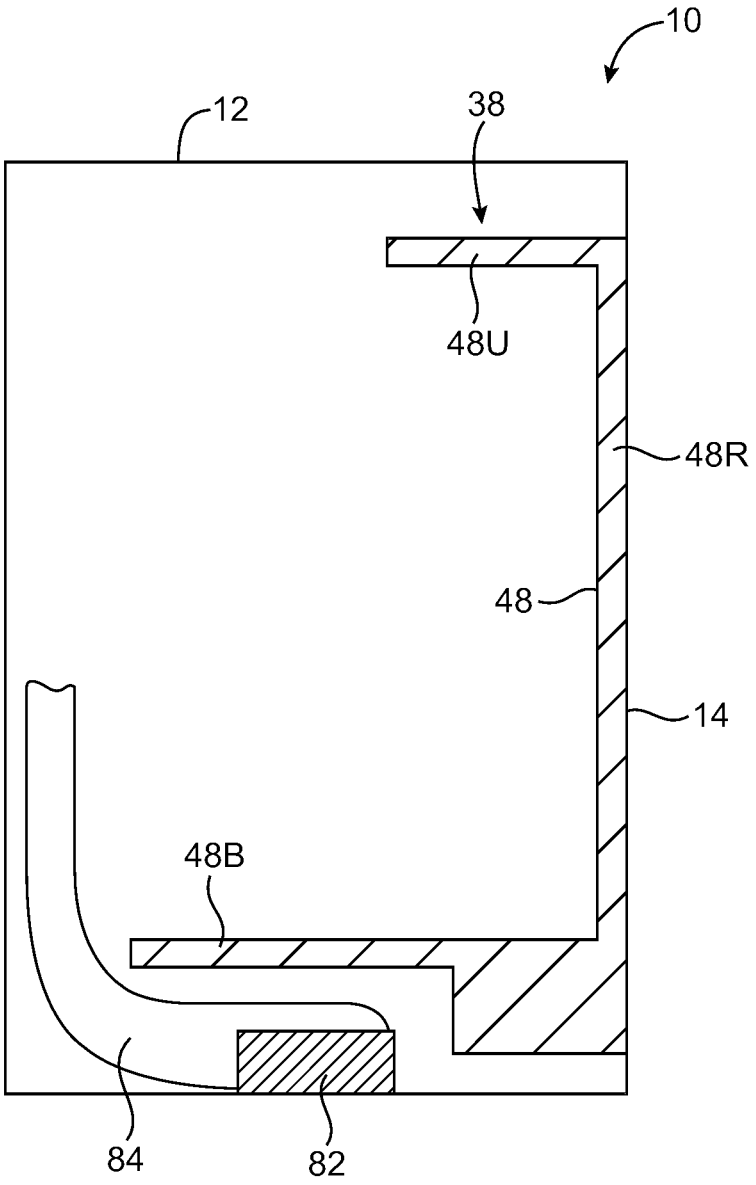
FIG. 17 is a top view of an illustrative slot antenna that has been configured to accommodate a flex circuit and a dock connector structure in a handheld electronic device in accordance with an embodiment of the present invention.

In the example of FIG. 17, slot 48 of antenna 38 has upper elongated portion 48U that is formed within the interior of housing 12, right-hand elongated portion 48R that is adjacent to the right-hand sidewall 14 of housing 12, and lower elongated portion 48B that is formed within the interior of housing 12. It may be advantageous to route slot 48 so that at least some of its length is within the interior of housing 12 to accommodate device components. In the FIG. 17 example, lower portion 48B is formed within the interior of device 10 to accommodate conductive structures such as 30-pin data connector 82 and associated flex circuit data path 84. Some conductive components in device 10 such as data port connector 82 may need to be mounted on one of sidewalls 14 of housing 12. This allows these conductive components to mate with cables or other external components. Because this restricts the layout of slot 48, devices 10 that include data connectors or other sidewall-mounted conductive structures may benefit from slot layouts for slot antenna 38 in which at least some of slot 48 is routed through an interior device region.

Figure 18:
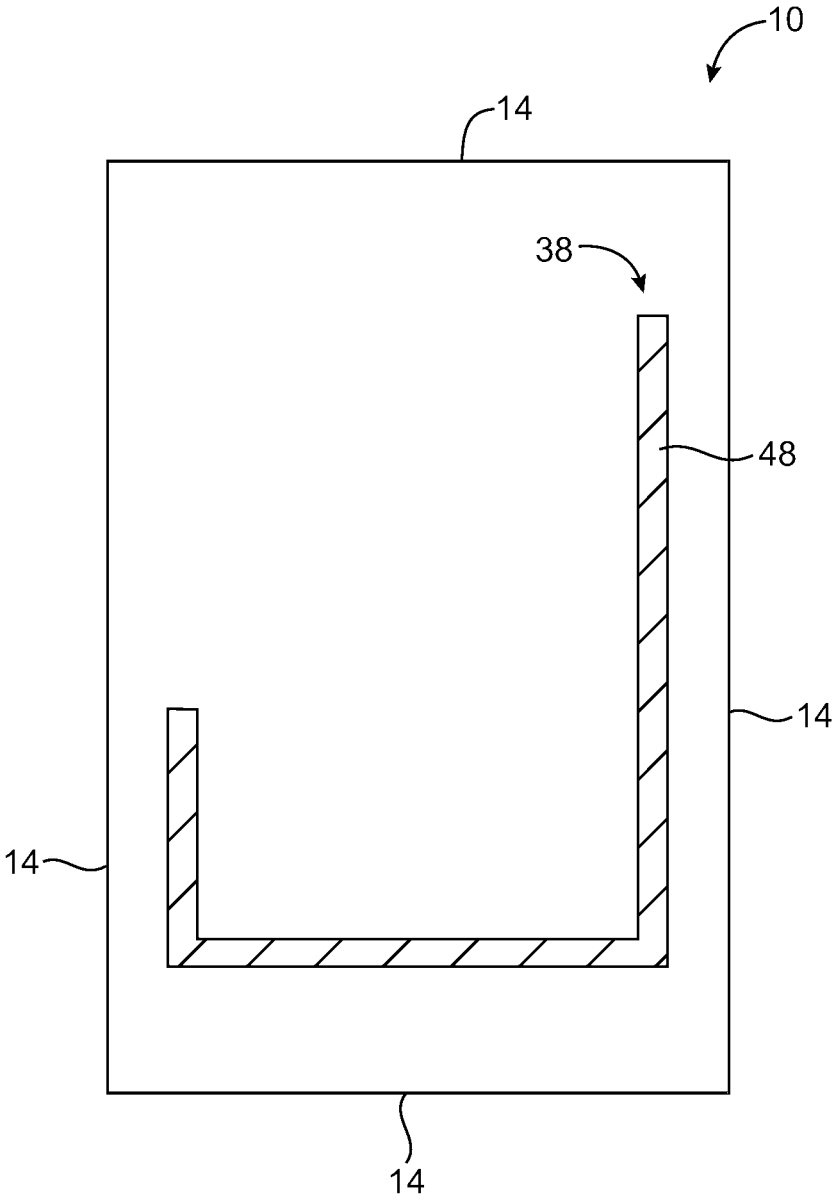
FIG. 18 is a top view of an illustrative slot antenna formed within the interior of a handheld electronic device away from the sidewall portions of the handheld electronic device in accordance with an embodiment of the present invention.

FIG. 18 shows how slot 48 of antenna 38 may be routed entirely within the interior of device 10, so that no portion of slot 48 is defined by the location of housing sidewalls 14. As with the other illustrative arrangements for slot antenna 38 that are described herein, the shape of slots such as slot 48 of FIG. 18 may be defined by conductive structures such as printed circuit board traces, electrical components, structural conductive members, housing portions, or any other suitable conductive materials in device 10.

Figure 19:
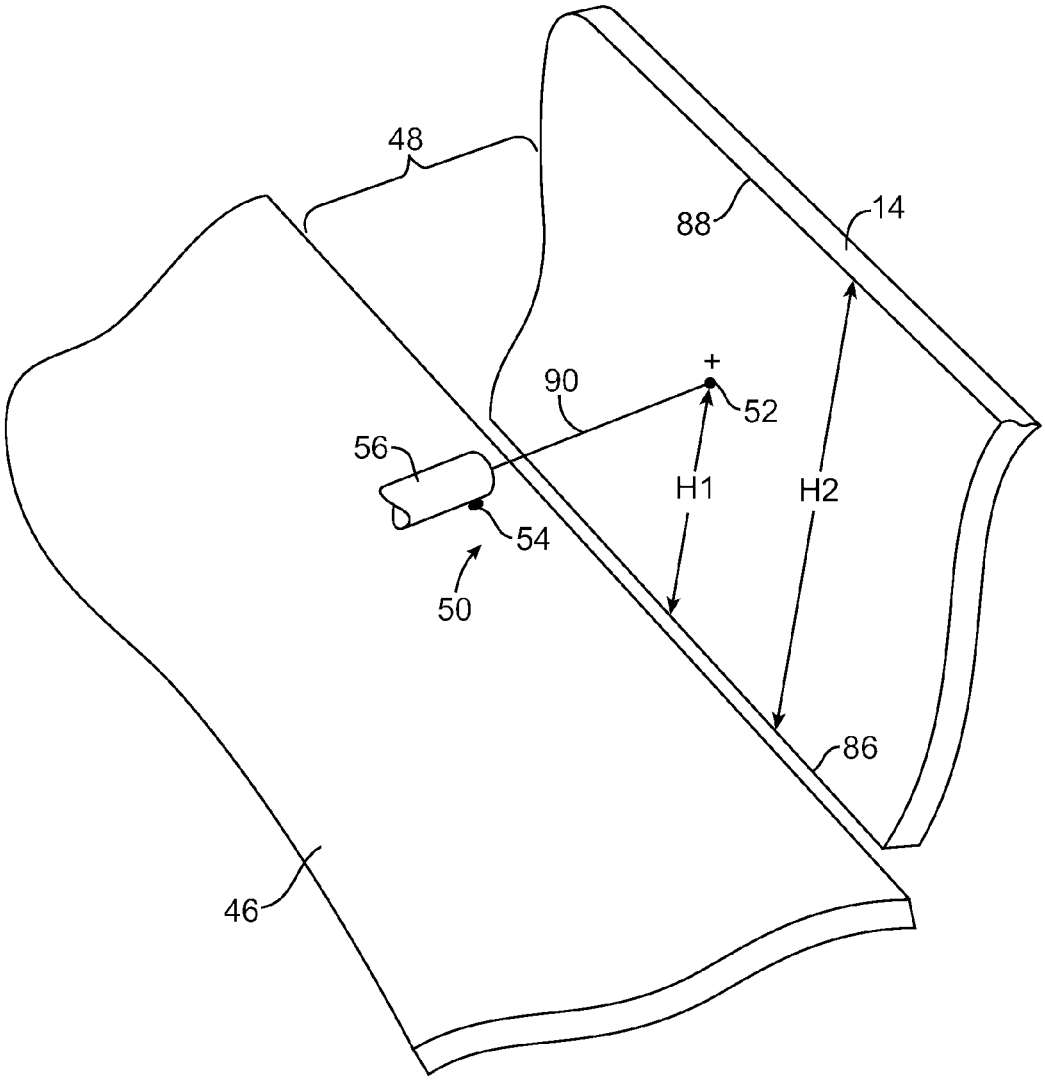
FIG. 19 is a perspective view of an interior portion of an electronic device showing how a slot antenna may be fed in accordance with an embodiment of the present invention.

It may be advantageous to feed slot 48 using a feed arrangement that is located at a vertical midpoint of sidewall 14. This type of arrangement is shown in FIG. 19. FIG. 19 shows a perspective view of an interior portion of device 10 in the vicinity of feed 50. Feed 50 has an associated positive antenna terminal 52 and an associated negative antenna terminal 54. Feed 50 bridges slot 48 and may be used to couple radio-frequency transceiver circuitry such as circuitry 40 of FIG. 5 to the antenna formed from slot 48. If desired, impedance matching components (e.g., capacitors, resistors, inductors, or components that produce controllable amounts of capacitance, resistance, and inductance) may be located in the vicinity of antenna feed 50 or may be incorporated into transmission line path 56. Such impedance matching structures are not shown in FIG. 19 to avoid over-complicating the drawing.

In the portion of slot 48 that is shown in FIG. 19, the shape of antenna slot 48 is determined by the air gap formed between housing sidewall 14 and conductive structures 46 (e.g., a printed circuit board). As shown in FIG. 19, antenna feed terminal 52 may be located at a vertical height H1 above sidewall edge 86. The total vertical dimension of sidewall 14, as measured between rear sidewall edge 86 and front sidewall edge 88 may be H2. The position of antenna terminal 52 may be adjusted so that H1 is about half of H2 (i.e., so that the antenna feed terminal is vertically located in the middle of sidewall 14). Other arrangements may also be used in which H1 is larger or smaller.

In the example of FIG. 19, antenna terminal 52 may be formed by soldering or welding transmission line center conductor 90 to the inner surface of sidewall 14. Similarly, antenna feed terminal 54 may be formed by soldering or welding an outer ground conductor portion of transmission line 56 to a conductive trace on the surface of printed circuit board 46. These are merely illustrative examples of techniques for forming antenna terminal connections. Electrical connections for feed 50 may, in general, be formed using any suitable technique.

Figure 20:
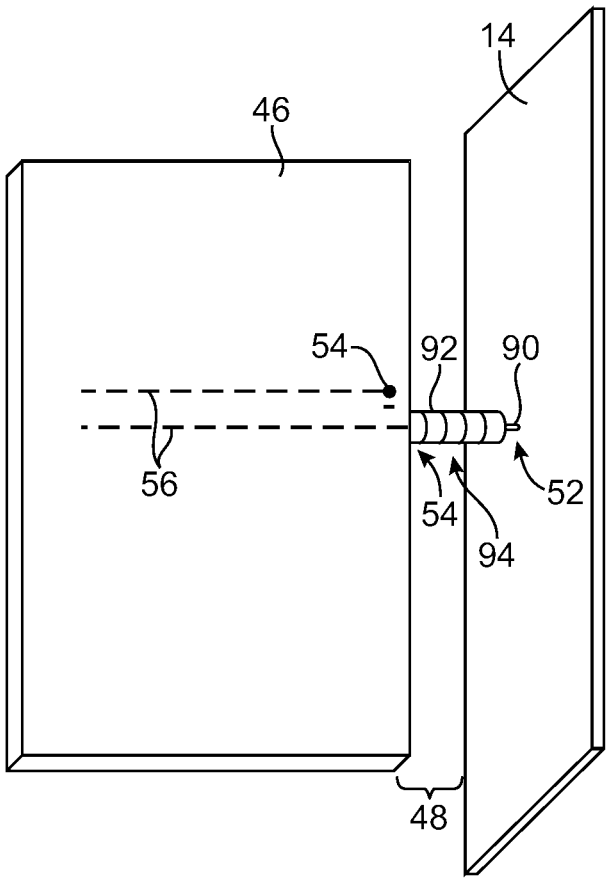
FIG. 20 is a perspective view of a portion of a slot antenna showing how a spring-loaded pin may be used in bridging the slot to form an antenna feed in accordance with an embodiment of the present invention.

As shown in FIG. 20, connections for antenna feed terminals 52 and 54 may be made using a spring-loaded pin such as pin 94. Pin 94 may contain a hollow barrel portion 92 in which protruding pin member 90 reciprocates. A spring or other biasing member within the hollow interior of barrel 92 may be used to press the tip of pin 90 against sidewall 14, thereby forming antenna terminal 52. Antenna terminal 54 may be formed by electrically connecting a ground conductor in path 56 to a trace on board 46 in the vicinity of pin 94 (as an example).

Figure 21:
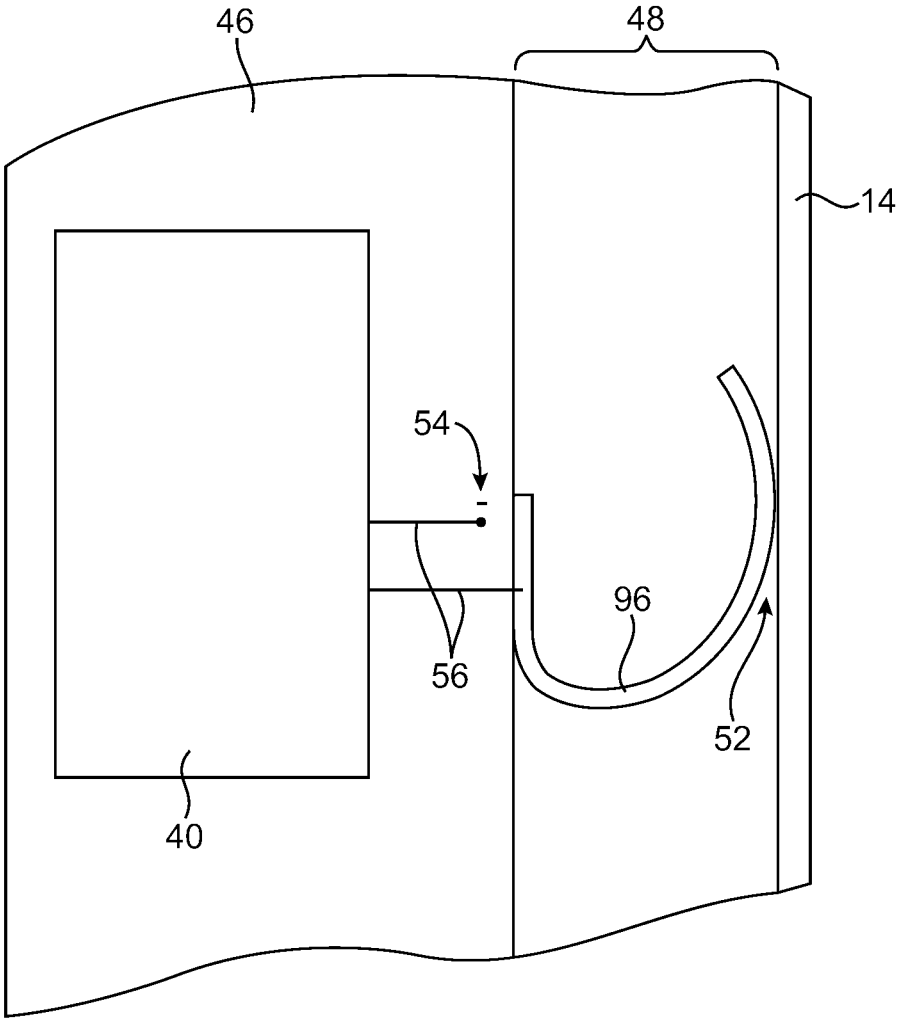
FIG. 21 is a cross-sectional view of a portion of a slot antenna showing how a spring may be used in bridging the slot to form an antenna feed in accordance with an embodiment of the present invention.

If desired, a spring that is formed from a bent metal structure or other suitable conductor may be used in forming antenna feed 50. This type of arrangement is shown in FIG. 21. As shown in the top view of FIG. 21, spring 96 may be used to bridge slot 48. On board 46, spring 96 may be electrically connected to the positive conductor in path 56 (e.g., using a connector, etc.). At the point at which spring 96 bears against the inner surface of sidewall 14, spring 96 forms antenna terminal 52. Antenna terminal 54 may be formed by connecting a ground conductor in path 56 to a suitable trace on board 46 (as an example).

Figure 22:
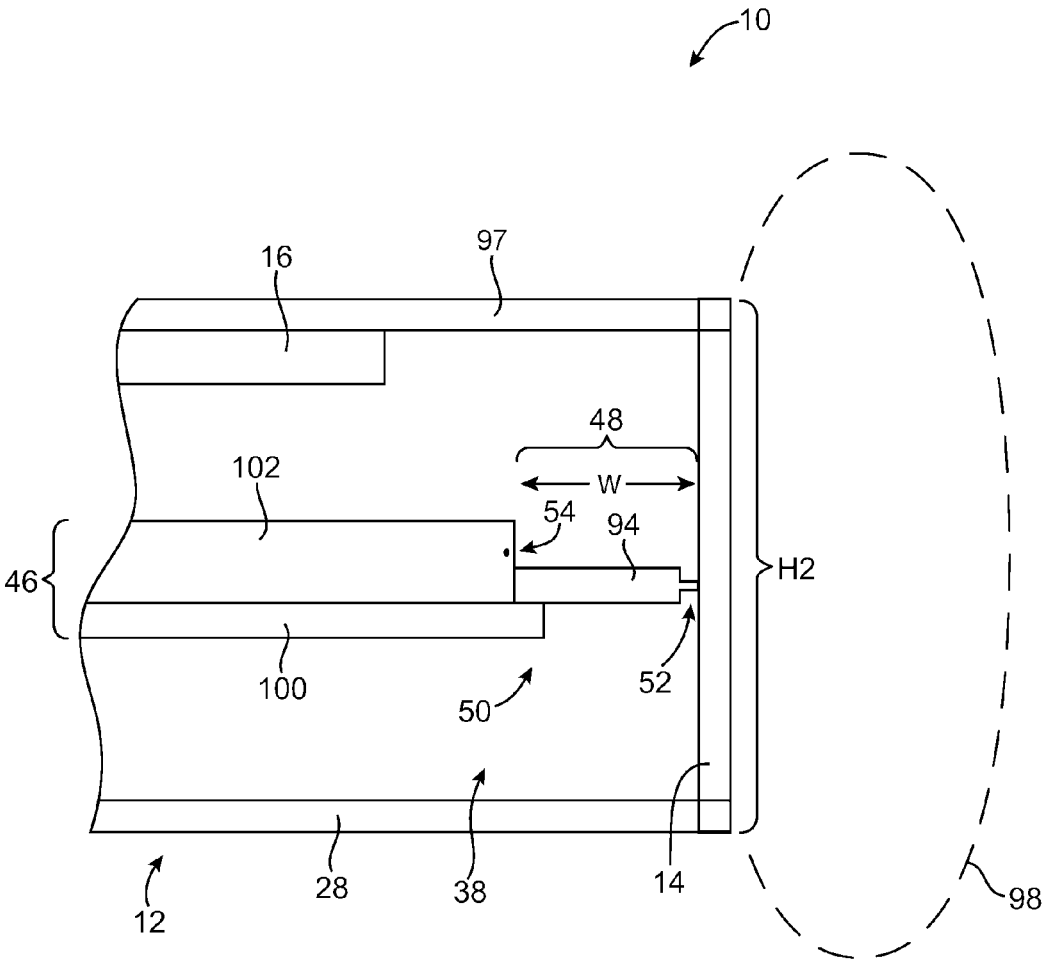
FIG. 22 is a cross-sectional end view of an illustrative handheld electronic device showing how formation of a slot antenna using a tall sidewall may help shield the slot antenna from proximity effects in accordance with an embodiment of the present invention.

In antenna arrangements in which the antenna feed is located at an intermediate height along sidewall 14, the vertical extent of sidewall 14 may help to shield antenna 38 from contact with external objects such as the fingers of a user's hand or other body parts. The potential ability of sidewall 14 to shield antenna 38 from proximity effects such as these is illustrated in the cross-sectional view of FIG. 22. As shown in FIG. 22, antenna feed 50 may be formed by a conductor such as pin 94 that bridges slot 48 and forms positive antenna terminal 52. Ground antenna terminal 54 may be formed using conductive trace 102 in printed circuit board 46 (as an example). Traces such as trace 102 may be formed on the surface or interior layers of a substrate such as printed circuit substrate 100.

Display 16 may be mounted under a dielectric cover such as transparent glass 97. Dielectric cover 97 may permit radio-frequency signals to be transmitted and received by slot antenna 38. Sidewall 14 may have a height H2. The magnitude of height H2 may be selected to provide sufficient interior volume in device 10 to house desired electrical components. As an example, height H2 may be about 7 mm, about 9 mm, less than 7 mm, more than 7 mm, less than 9 mm, more than 9 mm, or any other suitable size. Height H2 may be larger than or smaller than the width W of slot 48. Particularly in scenarios in which height H2 is relatively large and width W is relatively small (e.g., when height H2 is equal to or larger than W), sidewall 14 may serve to shield slot 48 and feed 50 from proximity effects due to the presence of external objects such as a user's hand (shown as object 98 in FIG. 22). By shielding slot 48 and feed 50 of antenna 38 from external objects 98 using sidewall 14, antenna 38 may exhibit enhanced immunity to proximity effects.

Figure 23:
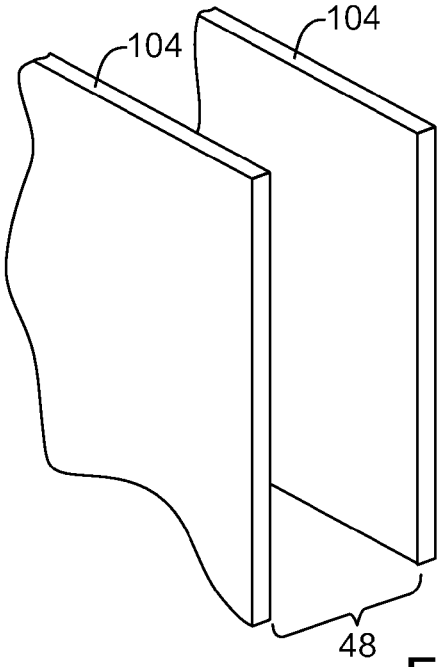
FIG. 23 is a cross-sectional perspective view of a portion of a slot antenna showing how the slot may be formed by parallel vertical planar structures in accordance with an embodiment of the present invention.

As shown in FIG. 23, slot 48 may be formed between two parallel planar conductive members 104 that form a dielectric-filled channel. Members 104 may include housing members such as sidewall 14, may be formed from other portions of housing 12, may be internal housing support structures, may be formed from conductive components, or may be formed from other conductive materials.

Figure 24:
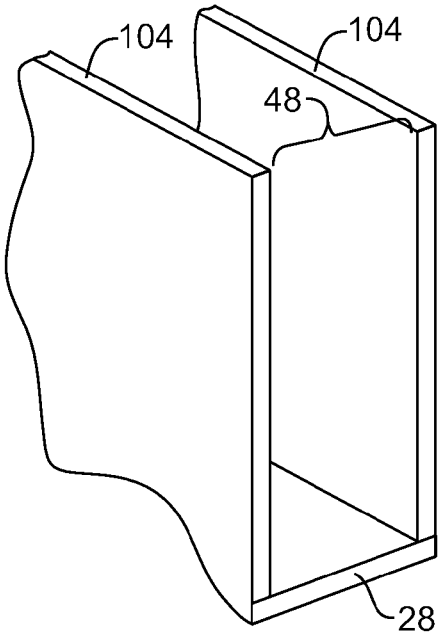
FIG. 24 is a cross-sectional perspective view of a portion of a slot antenna showing how the slot may be formed by parallel vertical structures and a conductive slot bottom structure in accordance with an embodiment of the present invention.

FIG. 24 shows an illustrative antenna arrangement in which slot 48 is formed from a channel between parallel planar conductive members 104 and that has a conductive lower planar portion 28. Portion 28 may be, for example, a portion of a rear housing surface or other conductive member.

Figure 25:
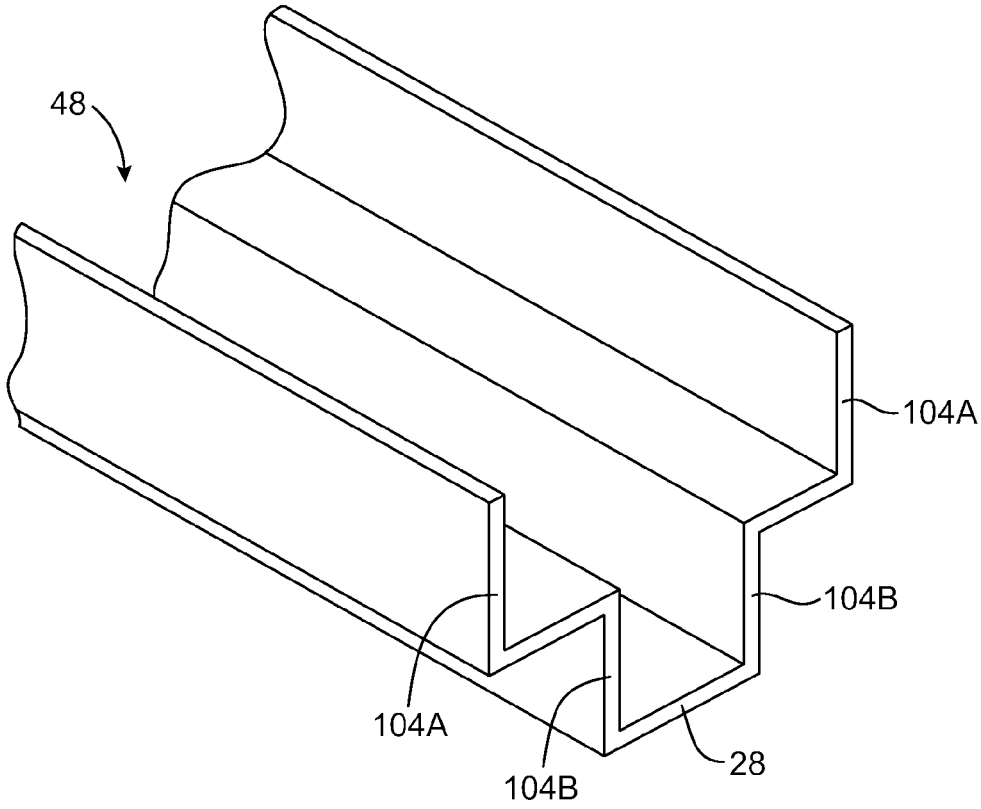
FIG. 25 is a cross-sectional perspective view of a portion of a slot antenna showing how the slot may be formed from a conductive structure with different slot widths in accordance with an embodiment of the present invention.

As shown in FIG. 25, the channel that forms gap 48 in antenna 38 may have multiple associated widths. Upper channel walls 104A may define a relatively wider slot width and lower channel walls 104B may define a relatively narrower slot width. Channel walls 104A and 104B may be formed from housing sidewalls and other suitable conductive structures such as internal electrical components in device 10. The example of FIG. 25 shows how slot 48 may have a conductive bottom member such as planar conductive member 28 (e.g., a portion of housing 12). This is merely illustrative. Multiwidth channels may be formed for antenna 38 with closed lower portions or with open lower portions. Moreover, there may be any suitable number of planar channel walls that form channels of any corresponding number of widths (e.g., channels with two widths, channels with three widths, channels with more than three widths, etc.). It is not necessary for the channels to have parallel walls. Rather, some or all of slot 48 may have tapered walls. Along the length of slot 48, different types of structures may be formed, so that portions of antenna 38 have multi-width antenna slot channels, portions of antenna 38 have a single width channel, and portions of antenna 38 have a slot without planar sidewalls (as an example). Combinations of these arrangements and the other illustrative slot antenna arrangements described herein may also be used.

As described in connection with FIG. 10, slot antenna 38 may be configured to support communications in five cellular telephone bands or other communications bands of interest. In general, antenna 38 and optional additional antennas in device 10 may support communications over any suitable wireless communications bands. For example, device 10 may be used to cover communications frequency bands such as cellular telephone voice and data bands at 850 MHz, 900 MHz, 1800 MHz, 1900 MHz, and 2100 MHz (as examples). Device 10 may also be used to handle the Wi-Fi® (IEEE 802.11) bands at 2.4 GHz and 5.0 GHz (also sometimes referred to as wireless local area network or WLAN bands), the Bluetooth® band at 2.4 GHz, and the global positioning system (GPS) band at 1575 MHz.

The foregoing is merely illustrative of the principles of this invention and various modifications can be made by those skilled in the art without departing from the scope and spirit of the invention.

What is claimed is:

1. An electronic device comprising:

at least one conductive structure;

a housing forming front and rear exterior surfaces of the electronic device and forming exterior conductive sidewalls of the electronic device, wherein the conductive sidewalls are disposed on at least three different sides of the housing;

an antenna formed at least partly from the conductive sidewalls and the conductive structure;

an antenna feed for the antenna that comprises a spring, wherein the antenna feed bridges an opening between the at least one conductive structure and the conductive sidewalls, wherein the antenna feed has a portion in contact with the conductive sidewalls, wherein the conductive sidewalls have a height and have a continuous length that wraps around a perimeter of the electronic device, wherein in electronic device has a height, a width, and a thickness, wherein the thickness of the electronic device is less than both the width and the height of the electronic device, wherein the height of the conductive sidewalls is substantially equal to the thickness of the electronic device, and wherein the antenna is not formed from an opening in the conductive sidewalls along the height of the conductive sidewalls.

2. The electronic device defined in claim 1 wherein the conductive sidewalls comprise a conductive sidewall member that surrounds the electronic device on top, right, left, and bottom edges.

3. The electronic device defined in claim 1 wherein the opening comprises a slot and wherein a conductive component is located in the slot.

4. The electronic device defined in claim 3 wherein the conductive component comprises a speaker.

5. The electronic device defined in claim 1 wherein the at least one conductive structure comprises a printed circuit board that forms an edge portion of the opening.

6. The electronic device defined in claim 1 wherein the opening comprises a slot and wherein the electronic device comprises a printed circuit board having an edge that defines at least part of the slot.

7. The electronic device defined in claim 1 wherein the opening comprises an L-shaped slot.

8. The electronic device defined in claim 7 wherein the L-shaped slot has first and second arms, wherein the first of the arms runs parallel to an adjacent part of the conductive sidewalls and has a shape defined at least partly by that part of the conductive sidewalls, and wherein the second of the arms is not adjacent to any of the conductive sidewalls.

9. The electronic device defined in claim 1 further comprising a radio-frequency transceiver coupled to the antenna, wherein the radio-frequency transceiver and the antenna are configured to operate in cellular telephone communications bands at 850 MHz, 900 MHz, 1800 MHz, 1900 MHz, and 2100 MHz.

10. The electronic device defined in claim 1 further comprising:

a display, wherein the conductive sidewalls surround the display.

11. The electronic device defined in claim 1 wherein the spring is coupled to the conductive sidewalls at an intermediate point along the height of the conductive sidewalls.

12. An electronic device comprising:

at least one conductive structure;

a housing forming front and rear exterior surfaces of the electronic device and forming exterior conductive sidewalls of the electronic device, wherein the conductive sidewalls are disposed on at least first, second, and third sides of the housing;

an antenna formed at least partly from the conductive sidewalls and the conductive structure; an antenna feed for the antenna that comprises a spring, wherein the antenna feed bridges an opening between the at least one conductive structure and the conductive sidewalls, wherein the antenna feed has a portion in contact with the conductive sidewalls, wherein the opening comprises a U-shaped slot having first and second arms and a portion between the first and second arms, wherein the antenna feed bridges the U-shaped slot, wherein the first arm is disposed along the first side of the housing, wherein the second arm is disposed along the second side of the housing, wherein the portion between the first and second arms is disposed along the third side of the housing, and wherein the antenna feed is disposed along the first arm and along the first side of the housing.

13. The electronic device defined in claim 12 wherein the two arms of the U-shaped slot have equal length.

14. The electronic device defined in claim 12 wherein the two arms of the U-shaped slot have unequal length.

15. The electronic device defined in claim 12 wherein the two arms in the U-shaped slot are adjacent to the sidewalls.

16. The electronic device defined in claim 12 wherein the first and second sides of the housing are substantially parallel to each other and wherein the third side of the housing is substantially perpendicular to the first and second sides of the housing.

17. An electronic device comprising:

a housing forming exterior sidewalls of the electronic device, wherein the sidewalls are formed from a ring of conductive material;

conductive structures that are separated from the ring of conductive material by an opening between the conductive structures and the ring of conductive material;

an antenna formed at least partly from the conductive structures and the ring of conductive material;

a radio-frequency transceiver coupled to the antenna; and a transmission line including first and second conductors, wherein the first conductor bridges the opening between the conductive structures and the ring of conductive material and is shorted to the ring of conductive material, wherein the second conductor is shorted to the conductive structures and does not bridge the opening between the conductive structures and the ring of conductive material, wherein the ring of conductive material has a height and has a continuous length that wraps around a perimeter of the electronic device, wherein the electronic device has a height, a width, and a thickness, wherein the thickness of the electronic device is less than both the width and the height of the electronic device, and wherein the height of the ring of conductive material is substantially equal to the thickness of the electronic device.

18. The electronic device defined in claim 17 further comprising:

a display, wherein the ring of conductive material surrounds the display.

19. The electronic device defined in claim 17 wherein the first conductor is coupled to the ring of conductive material at an intermediate point along the height of the ring of conductive material.

20. An electronic device comprising:

a housing forming an exterior front surface of the electronic device, the front surface having a total surface area and forming exterior conductive sidewalls of the electronic device, wherein each of the conductive sidewalls has a total surface area that is less than the total surface area of the front surface of the housing;

first and second conductive structures;

a slot antenna having a slot with a slot shape that is defined partly by the conductive sidewalls and partly by the first and second conductive structures, wherein at least a portion of the slot is disposed between the first and second conductive structures, wherein the slot shape has first and second perpendicular elongated slot regions, and wherein the slot shape comprises an L-shape; and an antenna feed that bridges the slot at a position that excites frequency harmonics sufficiently for the slot antenna to cover at least five communications bands, wherein the antenna feed comprises a first antenna terminal in direct contact with at least one of the conductive sidewalls.

* * * * *

UNITED STATES PATENT AND TRADEMARK OFFICE

CERTIFICATE OF CORRECTION

PATENT NO. : 8,665,164 B2
APPLICATION NO. : 12/274311
DATED : March 4, 2014
INVENTOR(S) : Robert J. Hill et al.

It is certified that error appears in the above-identified patent and that said Letters Patent is hereby corrected as shown below:

In the claims

In claim 1, column 14, line 47, delete "wherein in the electronic device has a height" and insert -- wherein the electronic device has a height --

Signed and Sealed this
Tenth Day of November, 2015

Michelle K. Lee

Michelle K. Lee
*Director of the United States Patent and Trademark Office*